US010456832B2

(12) United States Patent
Richaud et al.

(10) Patent No.: US 10,456,832 B2
(45) Date of Patent: Oct. 29, 2019

(54) TUNDISH OUTLET MODIFIER

(71) Applicant: VESUVIUS CRUCIBLE COMPANY, Wilmington, DE (US)

(72) Inventors: Johan L. Richaud, Cheval Blanc (FR); Martin Kreierhoff, Sudlohn (DE)

(73) Assignee: VESUVIUS USA CORPORATION, Champaign, IL (US)

( * ) Notice: Subject to any disclaimer, the term of this patent is extended or adjusted under 35 U.S.C. 154(b) by 60 days.

(21) Appl. No.: 15/738,579

(22) PCT Filed: Jun. 9, 2016

(86) PCT No.: PCT/US2016/036558

§ 371 (c)(1),
(2) Date: Dec. 21, 2017

(87) PCT Pub. No.: WO2017/003657

PCT Pub. Date: Jan. 5, 2017

(65) Prior Publication Data

US 2018/0185914 A1 Jul. 5, 2018

Related U.S. Application Data

(60) Provisional application No. 62/188,386, filed on Jul. 2, 2015.

(51) Int. Cl.
*B22D 41/50* (2006.01)
*B22D 11/118* (2006.01)
(Continued)

(52) U.S. Cl.
CPC ..... *B22D 41/507* (2013.01); *B22D 11/118* (2013.01); *B22D 41/08* (2013.01); *B22D 41/16* (2013.01); *B22D 43/001* (2013.01)

(58) Field of Classification Search
CPC ..... B22D 11/118; B22D 41/08; B22D 41/16; B22D 41/507; B22D 43/001
(Continued)

(56) References Cited

U.S. PATENT DOCUMENTS 3,499,587 A * 3/1970 Klaus ..... B22D 41/24 222/545
3,633,654 A * 1/1972 Auman ..... B22D 11/0642 164/432
(Continued)

FOREIGN PATENT DOCUMENTS

CN 1136787 11/1996
CN 1481955 A 3/2004
(Continued)

*Primary Examiner* — Scott R Kastler
*Assistant Examiner* — Michael Aboagye
(74) *Attorney, Agent, or Firm* — Thomas Clinton; Donald M. Satina

(57) ABSTRACT

A refractory block configured to surround an outlet modifies, within a refractory vessel, the flow of molten metal passing through the outlet. The block takes the form of a base through which a main orifice passes, and a wall extending upwards around the periphery of the base. Structural features that may be included in the block include a circumferential lip around the exterior of the wall, an interior volume in which the radius decreases downwardly towards the main orifice in a plurality of steps, and flow openings in the wall that are configured to induce swirling in the flow pattern in the interior volume of the block.

14 Claims, 26 Drawing Sheets

(51) Int. Cl.
*B22D 41/16* (2006.01)
*B22D 41/08* (2006.01)
*B22D 43/00* (2006.01)

(58) Field of Classification Search
USPC ..... 222/591, 597, 606, 607; 266/236; 164/335, 337, 437
See application file for complete search history.

(56) References Cited

U.S. PATENT DOCUMENTS

| | | | | |
|---|---|---|---|---|
| 4,079,868 | A | 3/1978 | Schlienger et al. | |
| 4,387,761 | A | 6/1983 | Metz | |
| 4,785,979 | A | 11/1988 | Svoboda et al. | |
| 5,544,695 | A | 8/1996 | Harasym | |
| 2005/0042189 | A1 | 2/2005 | Richaud | |
| 2009/0218375 | A1 | 9/2009 | Ledbetter | |
| 2011/0057364 | A1 | 3/2011 | Schlienger et al. | |
| 2014/0061257 | A1* | 3/2014 | Janssen ..... | B22D 41/502 222/590 |

FOREIGN PATENT DOCUMENTS

| | | | |
|---|---|---|---|
| CN | 206083842 | U | 4/2017 |
| DE | 19959540 | A1 | 6/2001 |
| EP | 2497585 | A1 | 9/2012 |

* cited by examiner

TUNDISH OUTLET MODIFIER

BACKGROUND OF THE INVENTION (1) Field of the Invention

The present invention relates to the continuous casting of steel and particularly to the problems of high residence time steel exiting the outlet of a refractory vessel and increased likelihood of clogging, and the deposition of nonmetallic inclusions at the outlet of a refractory vessel. The invention is configured to prevent vortex tubes from reaching the outlet and carrying slag to the outlet, and introduces controlled turbulence in the outlet to delay the deposition of nonmetallic inclusions. The invention is also configured to combine cold steel at the bottom of a refractory vessel, in a controlled manner, with steel in the body of the vessel to homogenize the temperature of steel exiting from the vessel and to avoid clogging produced by the passage of an excessive proportion of cold steel. In particular, the invention relates to a refractory piece that modifies the liquid steel flow inside a refractory vessel as the flow is directed towards the outlet. The refractory piece may achieve these effects in conjunction with a stopper. The invention also relates to an assembly comprising a refractory piece as described previously, in conjunction with a stopper. The stopper may have a rippled exterior; the ripples may form concentric rings on the end of the stopper in proximity to the outlet of the refractory vessel.

With growing demands for quality and property control, cleanliness of steel becomes more and more important. Issues like controlling the chemical composition and the homogeneity remain important, but have been joined by concerns generated by the presence of non-metallic inclusions and by clogging.

The presence of aluminum oxide and spinel inclusions is considered as harmful both for the production process itself as for the steel properties. These inclusions are mainly formed during the deoxidation of the steel in the ladle, which is necessary for continuous casting. Incomplete removal of the non-metallic inclusions during secondary metallurgy and reoxidation of the steel melt cause nozzle clogging during continuous casting. The layer of clogged material contains generally large clusters of aluminum oxide. Its thickness is related to the amount of steel cast as well as to the cleanliness of the steel. Nozzle clogging results in a decreased productivity, because less steel can be cast per unit of time (as result of the decreasing diameter) and due to replacement of nozzles with concurrent casting interruptions. Besides clogging, the presence of reoxidation products may give rise to erosion of the nozzle and to the formation of inclusion defects in the steel.

Clogging can also be produced by the entrainment of materials at or near the surface of the molten metal (e.g., slag) in the molten metal itself. Transferring molten metal from a metallurgical vessel also involves the separation of an impurity containing slag (the supernatant light phase) from a refined or partly refined metal (steel) below. As the flow from the vessel takes place, it is not uncommon for a funnel or vortex to be created which can entrain large amounts of slag into the flow of the liquid metal with resulting metal quality problems downstream.

(2) Description of Related Art

Flow behavior in an emptying vessel is influenced by the rotational velocity components in the liquid. In the absence of such velocity components, liquid leaving the emptying vessel is drawn mainly from a hem i-spheroidal region surrounding the exit nozzle, and surface liquid far above the drainage nozzle shows little motion. Toward the very end of the drainage, entrainment of the supernatant fluid does occur as a non-vortexing funnel through a funnel-shaped core.

It would therefore be desirable to provide a solution which would produce the homogenization of the temperature of molten steel passing through the outlet of a refractory vessel, and the reduction or delay of the deposition of nonmetallic inclusions in or below the outlet, while avoiding vortexing and entrainment of supernatant fluid in the exit flow form the refractory vessel.

BRIEF SUMMARY OF THE INVENTION

The objects of the present invention are the homogenization of the temperature of molten steel passing through the outlet of a refractory vessel, and the reduction or delay of the deposition of nonmetallic inclusions in or below the outlet.

These objects are achieved by a refractory piece or block that modifies, within a refractory vessel, the liquid steel flow directed towards the outlet. It may, alone or in conjunction with other refractory pieces, prevent vortex tubes from reaching the outlet. It may control the mixing of cold or high residence time steel with higher-temperature steel with a lower residence time, in the vicinity of the outlet. It may introduce turbulence downstream of the refractory vessel outlet to delay the deposition of nonmetallic inclusions, for example, at the entrance of a casting channel located at the refractory vessel outlet.

Specifically, these objects are achieved by the use of a block or surrounding refractory element, an assembly of a nozzle and a block or surrounding refractory element, or an assembly of a nozzle and a block or surrounding refractory element housed in a refractory vessel such as a tundish, in which the block or surrounding refractory element has a base having an upper surface, a bottom and a wall extending upwardly from the main surface, the wall extending upwards typically at the periphery of the main surface. The wall may be continuous or may be comprised of a plurality of protrusions extending upwardly from the main surface. The block or surrounding refractory element comprises, in the base, an opening that may be disposed to be in fluid communication with the outlet of the refractory vessel. In this configuration, the base of the block or surrounding refractory element surrounds the outlet of the refractory vessel.

This basic configuration of the block or surrounding refractory element may be modified by the inclusion of one or more, in any combination, design features to achieve the desired effects of the invention.

A first design feature is a circumferential lip extending radially outwardly from the circumferential external surface of the wall of the block or surrounding refractory element. The contents of the volume beneath the circumferential lip are impeded from flowing directly through the outlet, and mix with the contents above the circumferential lip in a controlled manner.

A second design feature is the presence of one or more fins on the interior surface of the block or surrounding refractory element. The fins extend inwardly. In certain configurations, the fins do not extend into the volume described by an upward projection of the outlet, or into a volume within a defined radial extension of an upward projection of the outlet.

A third design feature is the introduction of a roughened surface onto the interior surface of the block or surrounding refractory element. The roughness may take the form of protrusions or steps. In certain configurations, the steps may be oriented so that their surfaces facing an upward projection of the outlet may be generated by rotation, around the primary axis of the outlet of a series of radii with lengths that incrementally decrease on proceeding towards the base lower surface.

A fourth design feature is the presence of one or more entrance flow openings extending from the wall circumferential external surface to the wall circumferential internal surface.

A fifth design feature is the presence of a plurality of barriers extending upwardly from the circumference of the base upper surface of the device to form the wall. Each barrier is circumferentially adjacent on each side to a circumferentially adjacent barrier.

The invention may contain the first feature, the second feature, the third feature, the fourth feature, the fifth feature, features 1 and 2, features 1 and 3, features 1 and 4, features 1 and 5, features 2 and 3, features 2 and 4, features 2 and 5, features 3 and 4, features 3 and 5, features 1, 2 and 3, features 1, 2, and 4, features 1, 2 and 5, features 2, 3 and 4, features 2, 3 and 5, features 1, 2, 3 and 4, or features 1, 2, 3 and 5.

Thanks to the particular arrangement according to the present invention, the cold molten steel at the bottom of a refractory vessel is mixed in a controlled ratio with hotter molten steel in the body of the refractory vessel. In addition, inclusions present in the metallurgical vessel flow past geometries in the block that induce turbulence as they exit; consequently they are entrained in the flow rather than precipitating from the molten metal stream and clogging the block outlet.

It must be understood that the element surrounding the nozzle can be of any appropriate shape. In function of the metallurgical vessel design; it can be circular, oval or polygonal; its main orifice can be central or eccentric. In an alternate embodiment of the invention, appropriate shapes for the element may exclude circular shapes. The element surrounding the nozzle can also be cut off so as to accommodate those cases when one or more tundish walls are close to the pouring orifice. The main surface of the element can be planar or not (it can be frusto-conical, rippled, inclined). The nozzle can be an inner nozzle (for example in case the molten steel flow is controlled with a slide gate valve or if the installation is equipped with a tube or calibrated nozzle changer) or a submerged entry nozzle or SEN (for example in the case of stopper control). The metallurgical vessel or tundish can be equipped with one or more of such devices.

As the element surrounding the nozzle need not be circular, and as the element may be placed in a vessel that does not have circular symmetry, it may be important to align the element with the nozzle, and therefore with the nozzle's surroundings, to produce desired flow patterns in the vicinity of the nozzle. Accordingly, the element and the nozzle may be constructed with matching visual indicators or markings that, when aligned or placed in contact, produce the desired geometrical arrangement of the element and the nozzle. Alternatively, the element and the nozzle may be constructed with mating geometries so that, when these geometries are mated, the desired geometrical arrangement of the element and nozzle, and of the combined element and nozzle with their surroundings, is produced. The mating geometries may be a matching recess and protrusion, a matching groove and lip, a matching peg and bore, a matching notch and protrusion, a matching dimple and mogul, a matching ridge and groove, aligned threaded receivers, aligned key or bayonet receivers, or matching non-circular surface geometries such as oval or polygonal faces. The mating geometry of the element may be placed within its main orifice or on the bottom of the base. The element, considered alone, may contain, within its main orifice or on its base, one or more orienting geometries, such as pegs, bores, protrusion, recesses, notches, bevels, dimples, moguls, ridges, grooves, housings for screw or bayonet fittings, or shaped or threaded receiver portions. The bore of the element may be asymmetric, oval or polygonal in shape.

According to the present invention, the refractory element comprises a base having a main surface and a wall surrounding the main surface, the upper surface of the periphery being higher than the base surface of the refractory element. It must be understood that the upper surface of the wall does not need to be planar. It can be waved or have different heights along its circumference (for example higher in area of its circumference close to a vessel lateral wall and lower on the other side). The wall may contain one or more interruptions or openings. The wall may contain stepped changes in height, or may contain gradual changes in height. The upper face of the wall may have a sawtooth configuration, a semicircular notch configuration, a square notch configuration, a wave configuration, a semicircular protrusion configuration or may contain one or more steps. The upper face of the wall may be in communication with an outwardly protruding lip. The upper face of the wall may be in communication with an inwardly protruding lip. In certain embodiments of the invention, the upper face of the wall may be completely exposed, having no direct contact with any other element of the block. The wall may consist of a plurality of cylinders, or solids in the form of vertical projections of polygons, arranged with longitudinal axes extending from, and perpendicular, to the upper surface of the base. The wall may contain one or more ports; these ports may be circular, oval or polygonal in shape, and the ports may have horizontal axes, axes directed upwards and inwardly, axes directed downwards and inwardly, or axes that are not perpendicular to the external surface of the periphery. The ports may have bottoms that are rectangular, rectangular with rounded corners, or formed by obtuse angles. The ports may be configured to have axes that are mutually tangent to a circle within the periphery. The ports may be inwardly flared so that the cross-section of a port increases in the direction of the main orifice.

In embodiments of the present invention having a wall circumferential lip, the distance from the upper surface of the base to the lower surface of the wall circumferential lip, designated "h", and the distance from the upper surface of the base to the upper surface of the wall, also expressed as the internal height of the device, designated "H", may be related as $2h<H<3h$, $2h<H<4h$, or $2h<H<5h$.

In embodiments of the present invention having a wall circumferential lip, the distance from the upper surface of the base to the lower surface of the wall circumferential lip, designated "h", and the distance from the exterior surface of the wall to the furthest extent of the lip, designated "p", may be related as $0.1h<p<2h$, $0.2h<p<2h$, or $0.5h<p<2h$.

In embodiments of the present invention having a wall circumferential lip, the distance from the upper surface of the base to the upper surface of the wall, also expressed as the internal height of the device, designated "H", may be related to the largest internal horizontal dimension, from interior surface of the wall to another portion of the interior surface of the wall, designated "2L", by the relationship $H\times\tan(10°)+50\text{ mm}<L<H\times\tan(70°)+15\text{ mm}$.

The periphery of the refractory element of the present invention may take the form of a wall with measurements that are related to other measurements of the element by particular ratios or ranges of ratios. In certain embodiments, the maximum height of the wall, measured from the bottom of the base, has a ratio of 1:1 to 6:1, or 1.1:1 to 6:1, to the minimum height of the wall, measured from the bottom of the base. In certain embodiments, the maximum height of the wall, measured from the bottom of the base, has a ratio of 0.1:1 to 10:1, or 0.1:1 to 8.5:1, or 0.2:1 to 8.5:1, or 0.5:1 to 8.5:1, to the maximum exterior diameter of the base. In certain embodiments, the wall has a minimum thickness of 2 mm, 5 mm, or 10 mm. In certain embodiments, the wall has a maximum thickness of 60 mm, 80 mm, or 100 mm. In certain embodiments, the base has a maximum thickness of 100 mm or 200 mm.

The periphery of the refractory element of the present invention may take the form of a wall that has an exterior surface that has a portion that is not vertical. In certain embodiments, the entire exterior surface of this wall is not vertical. In certain embodiments, the entire wall forms an obtuse angle with the main surface, as measured from the interior of the element. In certain embodiments, the angle between the bottom surface of the base and the exterior surface of the wall has an angle lying within the ranges of 45 degrees to 89.5 degrees and 90.5 degrees to 135 degrees. In certain embodiments, the angle between the bottom surface of the base and the exterior surface of the wall may vary around the circumference of the element. In particular embodiments, the element has non-vertical outer walls, and the element partially encloses a volume with a cross-section that decreases in size with decreasing distance to the nozzle or to a port in which the nozzle may be located. The walls may take the form of a cylinder with an axis that is not orthogonal to the horizontal plane. The walls may take the form of the radial surface of a truncated cone with a projected vertex below the plane of the main surface. The walls may take the form of the radial surface of a truncated cone with a projected vertex above the plane of the main surface. The upper face of the wall may form a circle, oval, or polygonal figure in a plane that is not parallel to the plane of the main surface.

The interior of the wall of the refractory element and the base of the refractory element may communicate, separately or together, with one or more vanes. A vane may be disposed so that a projection of the plane of the vane intersects the axis of the nozzle. A vane may also be disposed so that no projection of a plane of the vane intersects the axis of the nozzle. The vanes may have surfaces and edges; the surfaces may be planar, may be curved in one or two dimensions, and may be smooth or have grooves. The edges of the vanes may be chamfered or have a sawtooth configuration, a semicircular notch configuration, a square notch configuration, a wave configuration, a semicircular protrusion configuration or may contain one or more steps.

The surrounding refractory element may be made from a gas-impervious material. To be regarded as gas-impervious, such material has an open porosity (at the temperature of use) which is lower than 20% (thus lower than the open porosity of conventional lining material which is typically higher than 30%). For refractory materials, the permeability is generally related to the porosity. Therefore a low porosity material has a low permeability to gases. Such a low porosity can be obtained by including oxygen scavenger materials (e.g. antioxidants) in the material constituting the surrounding element. Suitable materials are boron or silicon carbide, or metals (or alloys thereof) such as silicon or aluminum. Preferably, they are used in an amount not exceeding 5 wt %. Alternatively (or in addition), products generating melting phase (for example $B_2O_3$) can also be included in the material constituting the surrounding element. Preferably, they are used in an amount not exceeding 5 wt. %. Alternatively or (in addition), materials forming more voluminous new phases (either upon reaction or the effect of the temperature) and closing thereby the existing porosity can also be included in the material constituting the preformed element. Suitable materials include compositions of alumina and magnesia. Thereby, steel re-oxidation in the area surrounding the nozzle is prevented. In certain embodiments of the invention, the refractory material has a permeability value less than 15 cD, 20 cD, 25 cD or 30 cD, according to standard ASTM testing. A material that may be used contains 0.5-1%, or 1-5% silica, 0.005% to 0.2% titania, 75% to 95% alumina, 0.1% to 0.5% iron (III) oxide, 0.5% to 1% magnesia, 0.1% to 0.5% sodium oxide, 0.25% to 2% boron oxide, and 1% to 10% of zirconia+hafnia. A suitable material may have a loss on ignition value of 0 to 5%.

The nozzle or element may be made from refractory oxides (alumina, magnesia, calcia) and may be isostatically pressed. To be regarded as gas-impervious in the sense of the present invention, a 100 g sample of the candidate material is placed in a furnace under argon atmosphere (a gentle stream of argon is continuously blown (about 1 l/min) into the furnace) and the temperature is raised to 1000° C. The temperature is then raised progressively to 1500° C. (in 1 hour) and is then left at 1500° C. for 2 hours. The loss of weight of the sample between 1000° C. and 1500° C. is then measured. This loss of weight must be lower than 2% for qualifying the material as gas-impervious. Thereby, not only the inclusion or reoxidation products cannot reach the nozzle but, in addition, they cannot form in the nozzle or the element. This particular combination provides thus a synergistic effect according to which a perfectly inclusion- and reoxidation product-free steel can be cast.

The material constituting the element can be selected from three different categories of materials:

a) materials which do not contain carbon;
b) materials essentially constituted of non reducible refractory oxides in combination with carbon; or
c) materials comprising elements which will react with the generated carbon monoxide. The selected material may have properties in two or three of the above categories.

Examples of suitable materials of the first category are alumina, mullite, zirconia or magnesia based material (spinel).

Suitable materials of the second category are, for example, pure alumina carbon compositions. In particular, these compositions should contain very low amounts of silica or of conventional impurities which are usually found in silica (sodium or potassium oxide). In particular, the silica and its conventional impurities should be kept under 1.0 wt. %, preferably under 0.5 wt. %.

Suitable materials of the third category comprise, for example, free metal able to combine with carbon monoxide to form a metal oxide and free carbon. Silicon and aluminum are suitable for this application. These materials can also or alternatively comprise carbides or nitrides able to react with oxygen compound (for example silicon or boron carbides).

The selected material may belong to the second or third categories, or to the second and third category.

A suitable material constituting the layer which will not produce carbon monoxide at the temperature of use can comprise 60 to 88 wt. % of alumina, 10 to 20 wt. % graphite and 2 to 10 wt. % of silicon carbide. Such a material contains oxygen getters such as non-oxide species such as nitrides or carbides, or non-reducible oxides, which can react with any oxygen present.

The surrounding element of the present invention comprises a main orifice adapted for matching engagement with at least a portion of the outer surface of a nozzle, a base surrounding the main orifice and a wall surrounding, and extending from, the main surface. Advantageously, the surrounding refractory element is made from a gas-impervious material. Thereby, steel re-oxidation in the area surrounding the nozzle is prevented. For example, a particularly suitable composition to this end is essentially comprised of a high alumina material comprising at least 75 wt. % of $Al_2O_3$, less than 1.0 wt. % of $SiO_2$, less than 5 wt. % of C, the reminder being constituted of refractory oxides or oxides compounds that cannot be reduced by aluminum (particularly aluminum dissolved in molten steel) at the temperature of use (for example calcia and/or spinel. A particularly suitable material is the CRITERION 92SR castable available from VESUVIUS UK Ltd. This material is a high alumina low cement castable material reinforced with fused alumina-magnesia spinel. A typical analysis of this product is the following:

| | |
|---|---|
| $Al_2O_3$ | 92.7 wt. % |
| MgO | 5.0 wt. % |
| CaO | 1.8 wt. % |
| $SiO_2$ | 0.1 wt. % |
| Other | 0.4 wt. % |

In a second characterization, the composition of the refractory element or block includes a resin-bonded material that is resistant to alumina deposition. The resin-bonded material includes at least one refractory aggregate, a curable resin binder and a reactive metal. The curable resin binder should be cured but should not be fired. Typically, the binder is organic and usually the binder is a carbon resin, such as, a carbonaceous binder derived from pitch or resin. The binder may include other types of organic binders, such as, phenolic compounds, starch, or ligno-sulfinate. Binder must be present in an amount for adequate green strength in the unfired piece after curing. Curing commonly occurs at below around 300° C. Heat treatment comprises heating the piece below firing temperatures, such as below about 800° C. or below about 500° C. The amount of binder will vary depending on, for example, the type of binder used and the desired green strength. A sufficient amount of binder will typically be from 1-10 wt. %.

In a composition according to the second characterization, reactive metal includes aluminum, magnesium, silicon, titanium, and mixtures and alloys thereof. Conveniently, reactive metals may be added as powders, flakes and the like. The reactive metal should be present in sufficient quantity so that, during casting of molten steel, the reactive metal scavenges any oxygen that may diffuse into or emanate from the refractory article. Oxygen is thereby restricted from contact or reaction with the molten steel or other refractory components. Various factors affect the amount of reactive metal that will be sufficient to scavenge oxygen. For example, the inclusion of oxygen-releasing compounds, such as silica, require higher levels of reactive metal in order to scavenge the released oxygen. Obviously, shrouding the resin-bonded material with inert gas will reduce the amount of oxygen reaching the resin-bonded material and, therefore, the required amount of reactive metal will decrease. Limitations on the amount of reactive metal include cost and hazardousness. Reactive metals are generally more expensive than refractory aggregates and, especially as powders, reactive metals can be explosive during processing. A typical amount of reactive metal is from 0.5-10 wt. %.

Importantly, the refractory material according to the second characterization is cured and is not fired until use. Use includes preheating or casting operations. Firing tends to destroy the resin binder and reactive metal components. During firing, the binder can oxidize, thereby reducing the physical integrity of the article, and the reactive metal can form undesirable compounds. For example, aluminum metal can react to form aluminum carbide under reducing conditions or aluminum oxide under standard atmosphere. An article comprising aluminum carbide is susceptible to hydration and destructive expansion. Aluminum oxide does not inhibit and may actually accelerate alumina deposition. In either case, the beneficial effect of aluminum metal is lost.

The refractory composition according to the second characterization may also include carbon, stable carbides, borates and antioxidants. Carbon is often added as graphite to reduce thermal shock and wettability by the steel. Carbon can be present in an amount up to 30 wt. %, but preferably less than about 15 wt. % is present. Stable carbides include carbides that do not form unstable oxides, oxides having a low vapor pressure, or oxides that are not reduced by alumina, titania or other rare earth oxides that are used in steel treatment such as, for example, cerium and lanthanum. Examples of stable carbides include aluminum carbide, titanium carbide, and zirconium carbide. Care should be taken to ensure that the carbide does not hydrate before use. Carbides can cause cracking in the article during preheating.

As the term is used in describing compositions according to the second characterization, antioxidants include any refractory compound that preferentially reacts with oxygen, thereby making the oxygen unavailable to the molten steel. Boron compounds are particularly effective and include elemental boron, boron oxide, boron nitride, boron carbide, borax and mixtures thereof. Boron compounds act as both a flux and an antioxidant. As a flux, boron compounds reduce porosity and permeability, thereby creating a physical barrier to oxygen diffusion and ingress. As an antioxidant, boron compounds scavenge free oxygen making it unavailable to the steel. Like reactive metals, firing destroys antioxidants while curing preserves their utility. The effective amount of antioxidant will vary depending on the one selected. An effective amount of boron compounds is typically from 0.5-7 wt. %.

According to yet another of its aspects, the invention is directed to a process for the continuous casting of steel which comprises pouring the molten steel through an element, as above described. The invention is also directed to the use of an element in the casting of steel.

BRIEF DESCRIPTION OF THE SEVERAL VIEWS OF THE DRAWINGS

The invention will now be described with reference to the attached drawings in which

FIG. 17 is a top view of a refractory element having an outward lip extending outwardly from a circumferential wall, entrance flow openings, and flow directors between the entrance flow openings and the major vertical axis of the element, the flow directors being in direct communication with the interior of the circumferential wall;

DETAILED DESCRIPTION OF THE INVENTION

Figure 1:
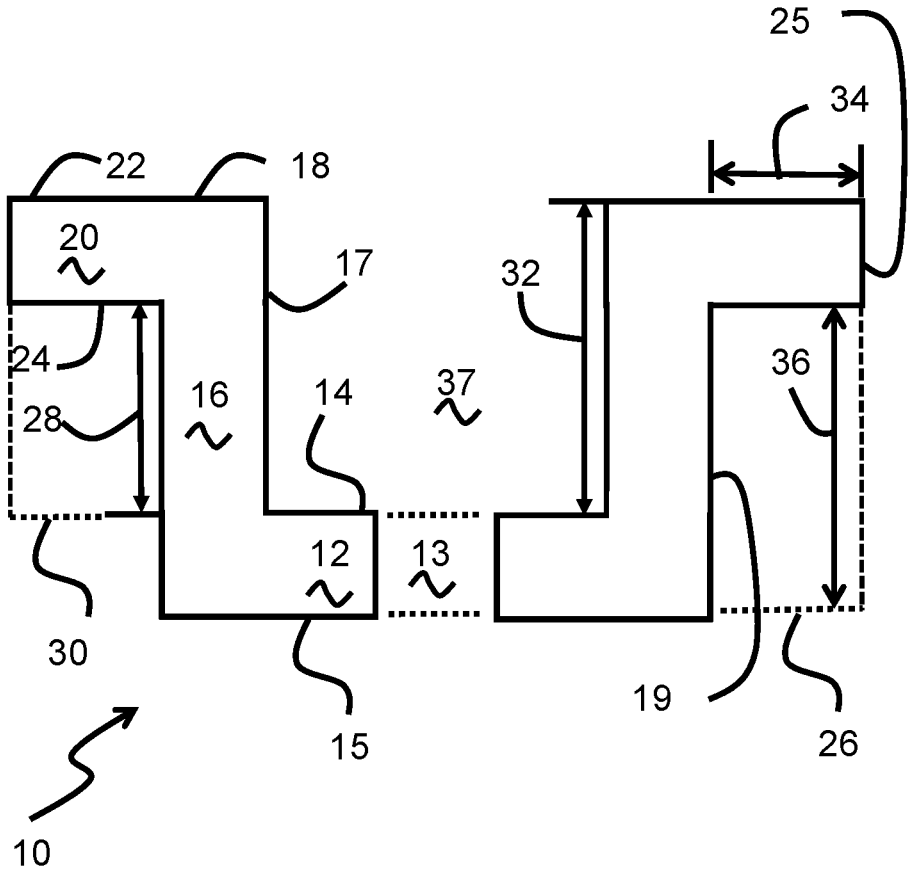
FIG. 1 is a perspective drawing of a refractory element configured as a block.

FIG. 1 is a cross-section representation of certain components of a refractory element 10 of the present invention, showing their geometric relationship. Refractory element 10 contains a base 12, which is depicted as being cylindrical in shape, and having a main orifice 13 which passes through the base from a base upper surface 14 to a base lower surface 15. A wall 16 extends upwardly from base upper surface 14. Wall 16 is disposed around the periphery of base 12. The wall has a wall interior surface 17, a wall upper surface 18 and a wall exterior surface 19. A wall circumferential lip 20 extends outwardly from wall 16. The wall circumferential lip 20 has a wall circumferential lip upper surface 22, a wall circumferential lip lower surface 24, and a wall circumferential lip exterior surface 25. In the representation in FIG. 1, wall upper surface 18 and wall circumferential upper surface 22 are coplanar. Shielded volume 26 is the volume located below the wall circumferential lower surface 24. Operating shielded height 28 is the distance between base upper surface 14 and wall circumferential lip lower surface 24. Operating shielded volume 30 is the volume located below the wall circumferential lip lower surface 24 between the plane of base upper surface 14 and the plane of wall circumferential lip lower surface 24. Internal height 32 is the distance between base upper surface 14 and wall upper surface 18. Wall circumferential lip protrusion distance 34 is the distance between wall exterior surface 19 and the farthest radial extent of wall circumferential lip 20. Shielded height 36 is the distance between the plane of base lower surface 15 and the plane of wall circumferential lip lower surface 24. An interior volume 37 is partly defined by wall interior surface 17 and base upper surface 14.

Figure 2:
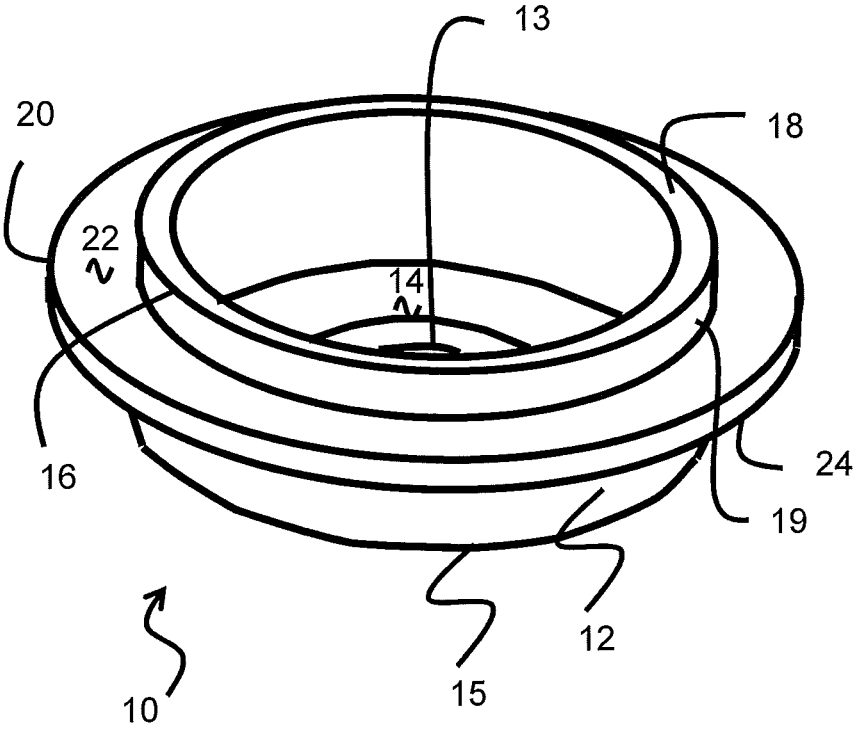
FIG. 2 is a perspective drawing of a refractory element having an outward lip located between the top and bottom of a circumferential wall.

FIG. 2 depicts a refractory element 10 having an outwardly-extending wall circumferential lip located between the top and bottom of a circumferential wall. The element has a base 12 through which main orifice 13 passes vertically. Wall 16 extends upwardly from base upper surface 14 of base 12. The wall has a wall upper surface 18. Wall circumferential lip 20 extends radially outward from wall 16. The wall circumferential lip 20 has a wall circumferential lip upper surface 22. In the representation in FIG. 2, wall upper surface 18 and wall circumferential lip upper surface 22 occupy different horizontal planes. The plane of the wall circumferential lip lower surface 24 is located above the plane of the base upper surface 14 and above the plane of the base lower surface 15.

Figure 3:
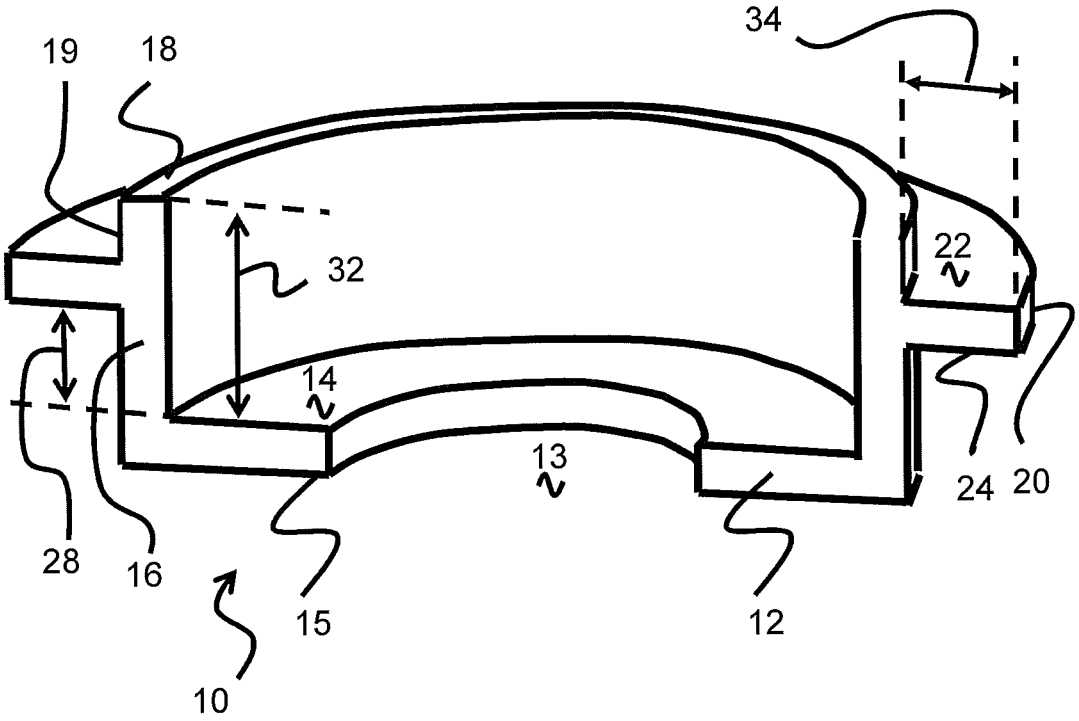
FIG. 3 is a cross-section of a perspective representation of a refractory element having an outward lip located between the top and bottom of a circumferential wall.

FIG. 3 depicts a refractory element 10 having an outwardly-extending wall circumferential lip 20 located between the top and bottom of a circumferential wall. The element has a base 12 through which main orifice 13 passes vertically. Wall 16 extends upwardly from base upper surface 14 of base 12. The wall has a wall upper surface 18. Wall circumferential lip 20 extends radially outward from wall 16. The wall circumferential lip 20 has a wall circumferential lip upper surface 22 and a wall circumferential lip lower surface 24. In the representation in FIG. 3, wall upper surface 18 and wall circumferential lip upper surface 22 occupy different horizontal planes. The plane of the wall circumferential lip lower surface 24 is located above the plane of the base upper surface 14 and above the plane of the base lower surface 15. Height "H" is the distance between base upper surface 14 and wall upper surface 18, and is equivalent to internal height 32. Height "h" is the distance between the plane of base upper surface 14 and the plane of wall circumferential lip lower surface 24, and is equivalent to operating shielded height 28. The radial outward extent of wall circumferential lip 22 from wall exterior surface 19, indicated as "p", is equivalent to lip horizontal protrusion distance 34.

Figure 4:
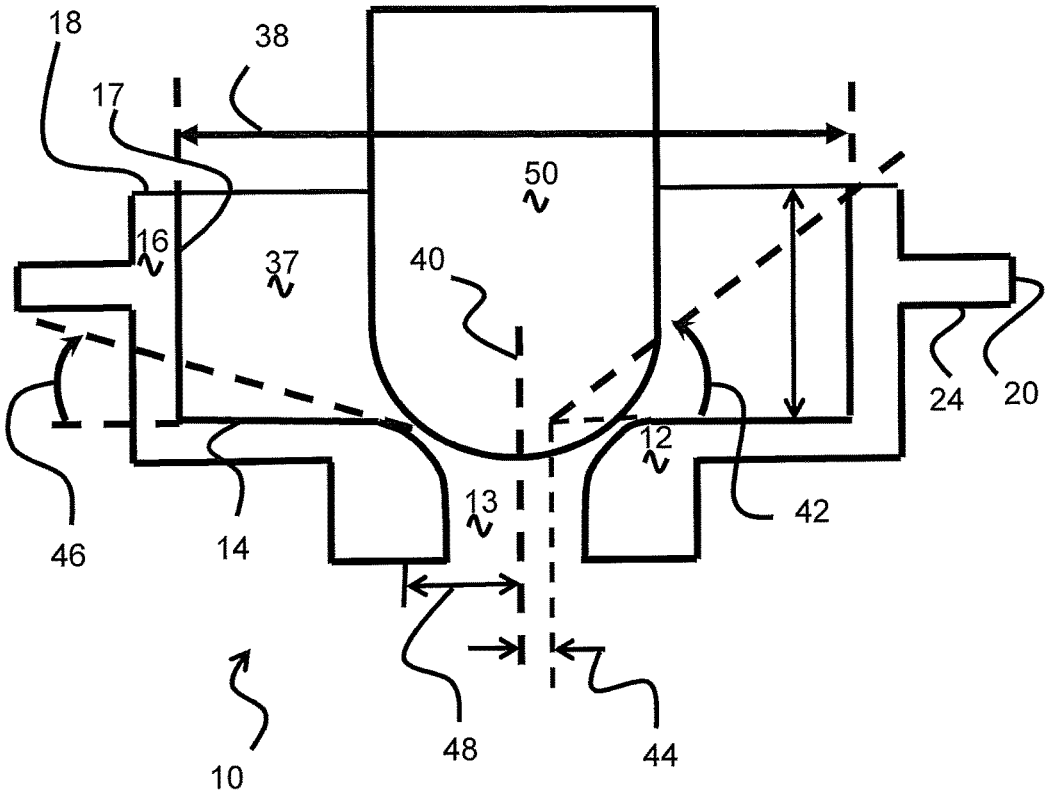
FIG. 4 is a vertical cross-section of a refractory element having an outward lip located between the top and bottom of a circumferential wall.

FIG. 4 depicts a refractory element 10 having an outwardly-extending wall circumferential lip 20 located between the top and bottom of a circumferential wall. The element has a base 12 through which main orifice 13 passes vertically. Wall 16 extends upwardly from the base upper surface of base 12. The wall has a wall interior surface 17 and a wall upper surface 18. Wall circumferential lip 20 extends radially outward from wall 16. The wall circumferential lip 20 has a wall circumferential lip lower surface 24. In the representation in FIG. 4, interior maximum horizontal dimension 38 represents the maximum straight-line distance in a horizontal plane between one portion of wall interior surface 17 and another portion of wall interior surface 17, and is also designated as "2×L" or "2L". Main orifice central axis 40 passes longitudinally, or vertically, through the main orifice 13. Element wall interior elevation angle 42 is described as the angle formed at the vertex of the intersection of a first line between (a) the intersection of wall interior surface 17 and wall upper surface 18 and (b) a point in the plane of base upper surface 14 displaced by a distance 44 (designated as "WDD") towards (a) from main orifice central axis 40, and a second line formed by the vertical projection of the first line on the plane of base upper surface 14. WDD 44 may have a value of 15 mm. WDD may also represent the minimum radius of main orifice 13. Lip lower surface elevation angle 46 is described as the angle formed at the vertex of the intersection of a first line extending between (a) the intersection of the wall circumferential lip external surface 25 and wall circumferential lip lower surface 24, and (b) a point in the plane of base upper surface 14 displaced by a distance 48 (designated as "LDD") towards (a) from main orifice central axis 40, and a second line formed by the vertical projection of the first line on the plane of upper base surface 14. LDD may have a value of 50 mm, or may have the value of the radius of main orifice 13 at its intersection with base upper surface 14, or may have the value of the minimum radius of main orifice 13.

In certain embodiments of the invention, element wall interior elevation angle 42 may have nonzero values less than 60 degrees, in the range from 60 degrees to 5 degrees, from 60 degrees to 10 degrees, from 60 degrees to 20 degrees, from 50 degrees to 5 degrees, from 50 degrees to 10 degrees, or from 50 degrees to 20 degrees.

In certain embodiments of the invention, lip lower surface elevation angle 46 may have values in the range from 10 degrees to 80 degrees, 15 degrees to 80 degrees, 10 degrees to 60 degrees, 10 degrees to 50 degrees, or 10 degrees to 45 degrees.

In certain embodiments of the invention, internal height 32 ("H") may be related to L (half the length of interior horizontal maximum dimension 38) by the relationship $$H\times\tan(10°)+LDD<L<H\times\tan(70°)+WDD$$

2×L is the largest internal horizontal dimension of the inventive device. For a device having a cylindrical exterior, 2×L represents the diameter, but the device may also have a square, rectangular, octagonal, triangular or other polygonal interior, or an oval interior.

Stopper volume 50 represents a volume of the interior of the device that may be occupied by a stopper in use. In the configuration shown, the stopper rod takes the form of a cylindrical solid with a hemispherical solid joined to the cylindrical solid by contact of respective circular surfaces.

Figure 5:
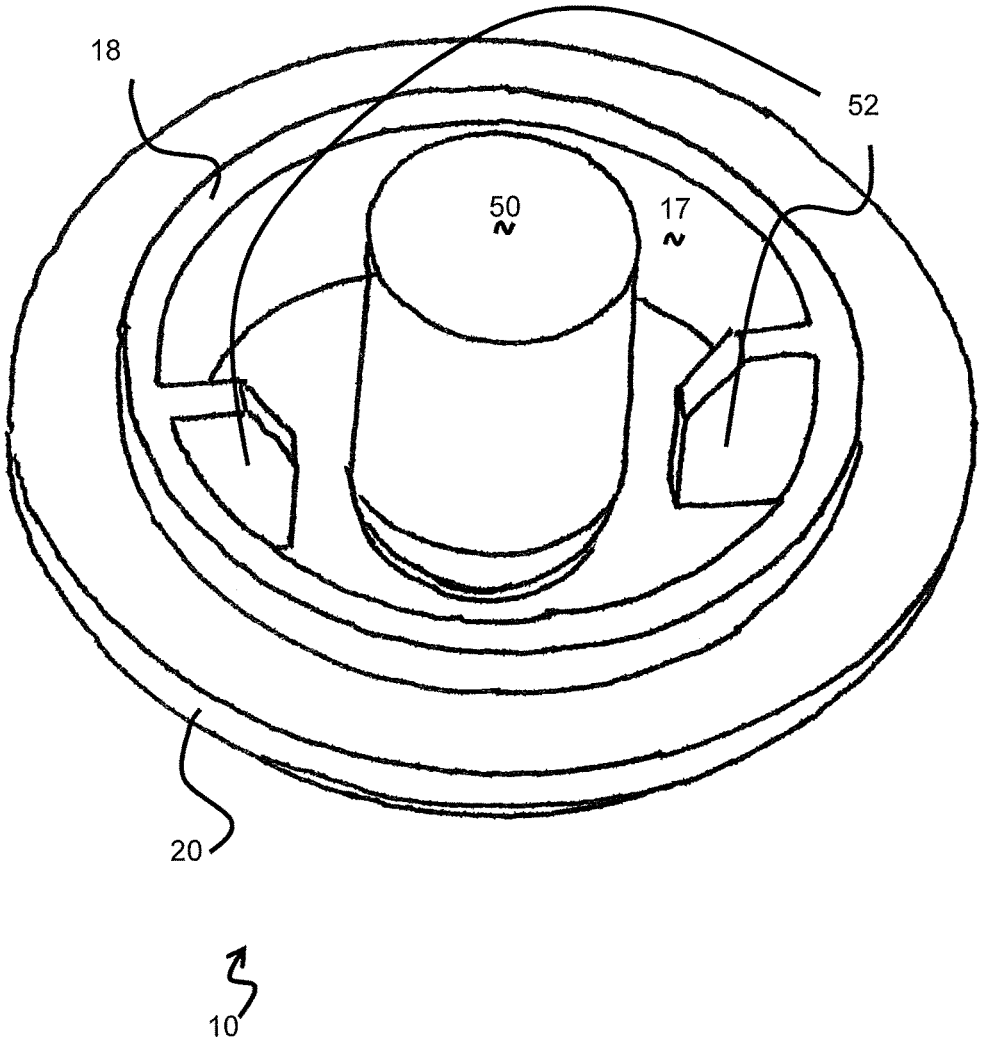
FIG. 5 is a perspective representation of a refractory element having an outward lip located between the top and bottom of a circumferential wall, and two internal fins.

FIG. 5 depicts an embodiment of refractory element or block 10 in which a pair of internal fins 52 extend inwardly into the interior volume from wall interior surface 17. Internal fins 52 cooperate with a stopper occupying stopper volume 50 to reduce the formation of vortices in the interior volume of block 10. Wall circumferential lip 20 is displaced below the plane of the wall upper surface 18, is displaced above the plane of the base lower surface, and is displaced above the plane of the base upper surface. In various embodiments a block of the present invention may contain 1, 2, 3, 4, 5, 6, 7, 8, 9, 10, 11, or 12 internal fins.

Figure 6:
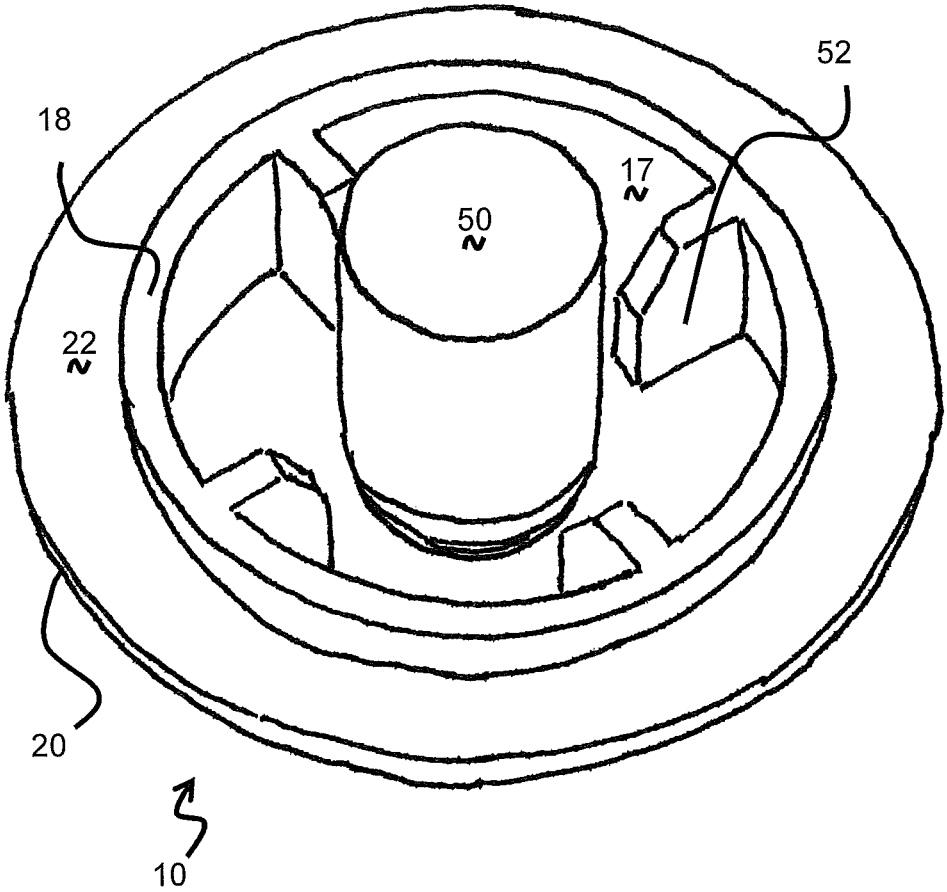
FIG. 6 is a perspective representation of a refractory element having an outward lip located between the top and bottom of a circumferential wall, and four internal fins.

FIG. 6 depicts an embodiment of refractory element or block 10 in which four internal fins 52 extend inwardly into the interior volume from wall interior surface 17. Internal fins 52 cooperate with a stopper occupying stopper volume 50 to reduce the formation of vortices in the interior volume of block 10. Wall circumferential lip 20 is disposed so that the plane of wall circumferential lip upper surface 22 is below the plane of the wall upper surface 18, and the plane of the wall circumferential lip lower surface is above the plane of the base lower surface, and above the plane of the base upper surface. In this embodiment, all molten metal must flow above wall circumferential lip upper surface 22 and above wall upper surface 18 to exit through the main orifice. Wall upper surface 18 is the uppermost portion or level of block 10.

Figure 7:
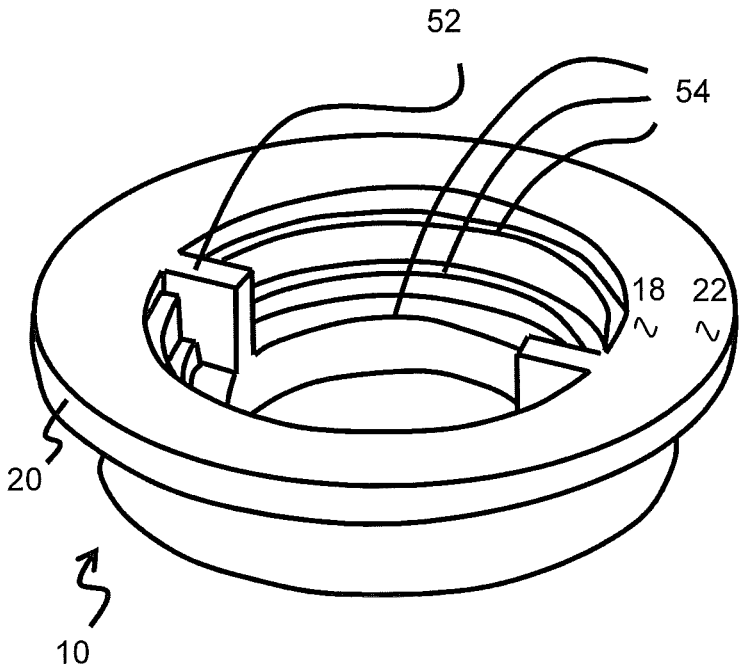
FIG. 7 is a perspective representation of a refractory element having a circumferential wall stepped interior surface and two internal fins.

FIG. 7 depicts an embodiment of refractory element or block 10 in which two internal fins 52 extend inwardly into the interior volume. The depicted embodiment contains three internal steps 54 formed in the face of the wall interior surface. The steps may be formed from right angles, obtuse angles, or may take the form of discrete bumps. In certain embodiments, a plurality of steps is required. In this embodiment, the wall circumferential lip upper surface 22 of wall circumferential lip 20 occupies the same plane as does the wall upper surface 18.

Figure 8:
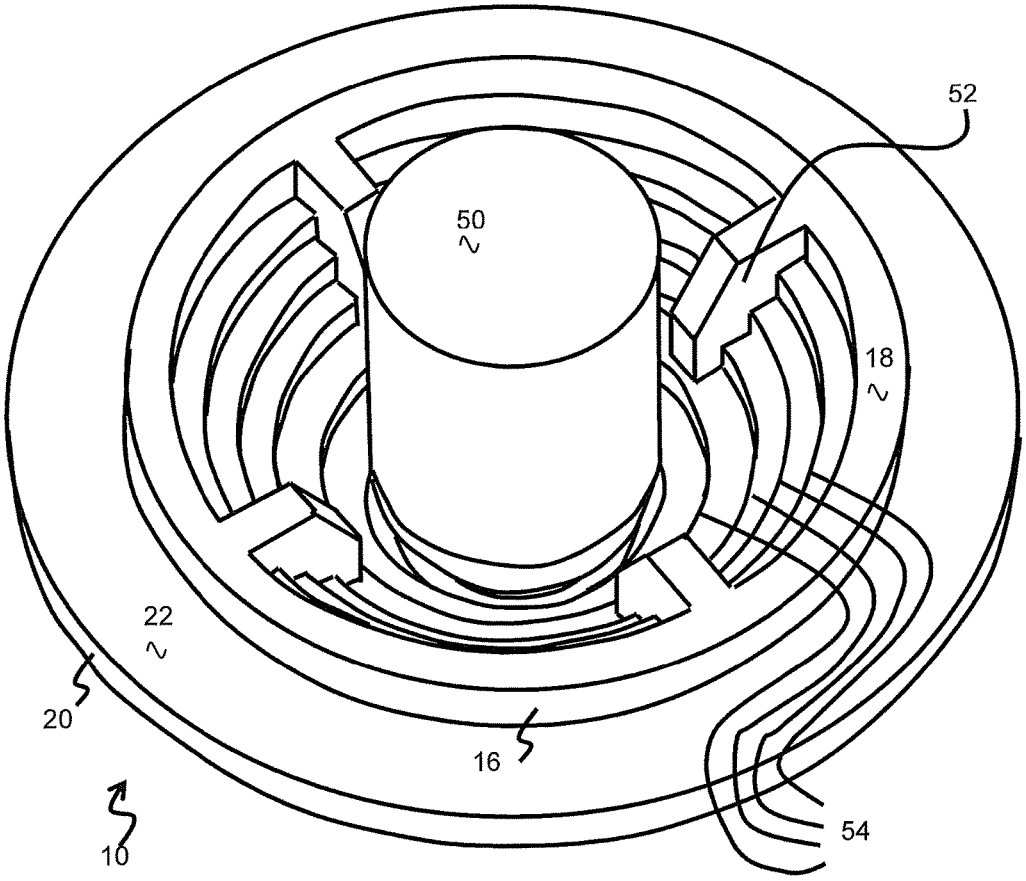
FIG. 8 is a perspective representation of a refractory element having a circumferential wall stepped interior surface and four internal fins.

FIG. 8 depicts an embodiment of refractory element or block 10 in which four internal fins 52 extend inwardly into the interior volume. The depicted embodiment contains four levels of internal steps 54 formed in the face of the wall interior surface. Fins 52 and steps 54 cooperate with a stopper occupying stopper volume 50 to minimize the formation of vortices and to produce turbulence in the flow through the main orifice to minimize deposition. The upper surface 22 of wall circumferential lip 20 is displaced downwardly from the plane of wall upper surface 18 of wall 16. The lower surface of the wall circumferential lip is displaced upwards from the base lower surface. In this embodiment, all molten metal must flow above wall circumferential lip upper surface 22 and above wall upper surface 18 to exit through the main orifice. Wall upper surface 18 is the uppermost portion or level of block 10. In various embodiments a block of the present invention may contain 1, 2, 3, 4, 5, 6, 7, 8, 9, 10, 11, 12, 13, 14, 15, or 16 levels of internal steps 54.

Figure 9:
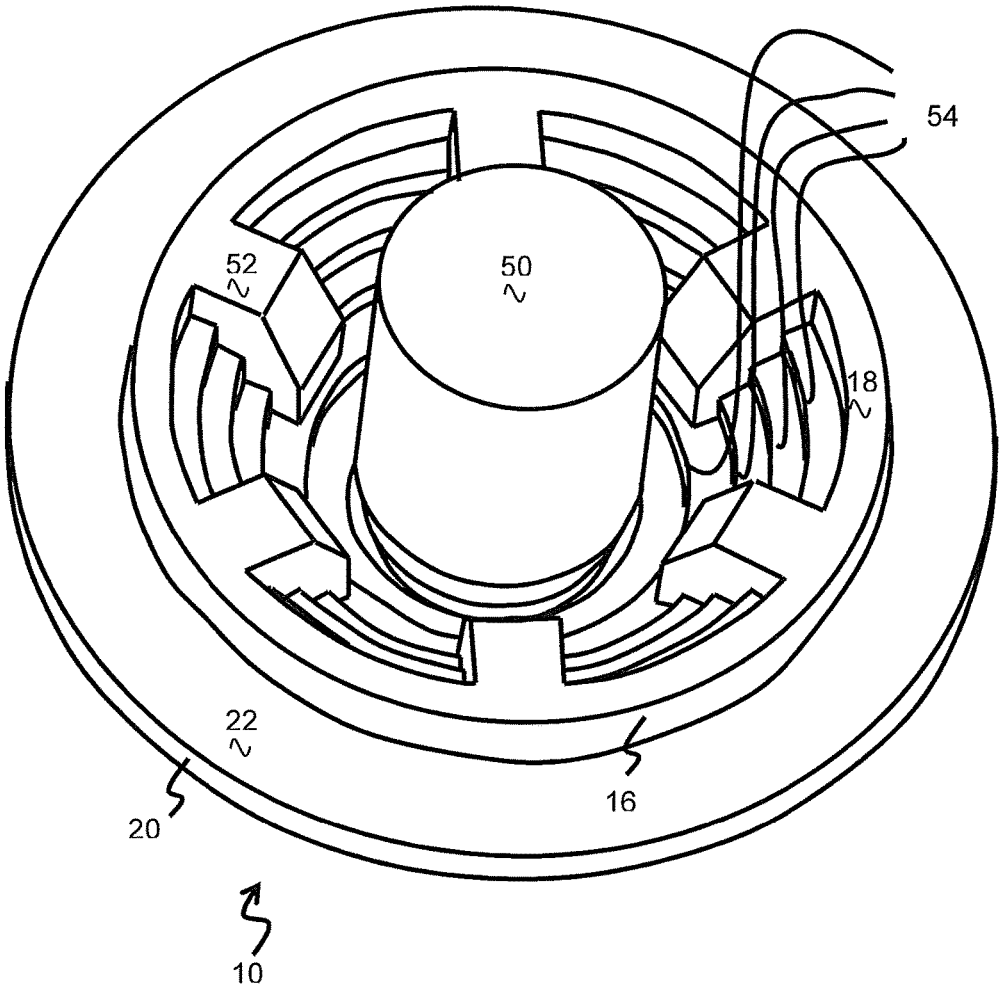
FIG. 9 is a perspective representation of a refractory element having a circumferential wall stepped interior surface and six internal fins.

FIG. 9 depicts an embodiment of refractory element or block 10 in which six internal fins 52 extend inwardly into the interior volume. The depicted embodiment contains four levels of internal steps 54 formed in the face of the wall interior surface. Fins 52 and steps 54 cooperate with a stopper occupying stopper volume 50 to minimize the formation of vortices and to produce turbulence in the flow through the main orifice to minimize deposition. The upper surface 22 of wall circumferential lip 20 is displaced downwardly from the plane of wall upper surface 18 of wall 16. The lower surface of the wall circumferential lip is displaced upwards from the base lower surface. In this embodiment, all molten metal must flow above wall circumferential lip upper surface 22 and above wall upper surface 18 to exit through the main orifice. Wall upper surface 18 is the uppermost portion or level of block 10.

Figure 10:
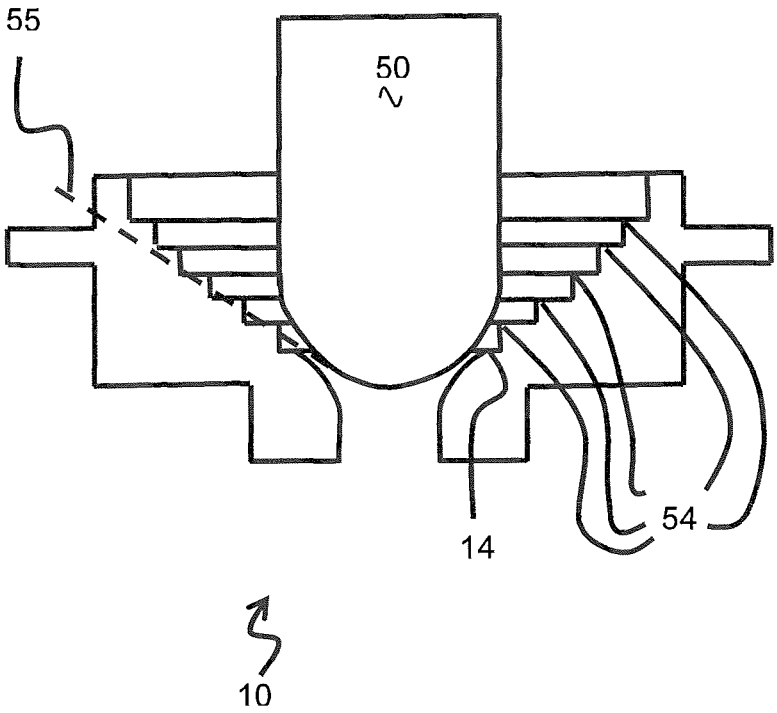
FIG. 10 is a cross-section representation of a refractory element having an outward lip located between the top and bottom of a circumferential wall, and a circumferential wall stepped interior surface.

FIG. 10 depicts an embodiment of refractory element or block 10 containing a plurality of levels of internal steps 54 formed in the face of the wall interior surface. Tangent line 55 is a line tangent to the surfaces of the nose of a stopper occupying stopper volume 50 and the seat of this stopper in the interior volume of block 10. In various embodiments of the invention, the tangent line intersects an internal step 54, a plurality of internal steps 54, or at least three internal steps 54. All of internal steps 54 are located at a level above the level of base upper surface 14. Base upper surface 14 is at the same level as the entrance of the tundish to mold casting channel where block 10 is used in a tundish. In such a configuration, the tundish to mold casting channel starts at the level of surface 14 or below. A step or a plurality of steps 54 is present in a block of the present invention; this configuration is distinguished from the use of a single step in the seat of a tundish to mold casting channel.

Figure 11:
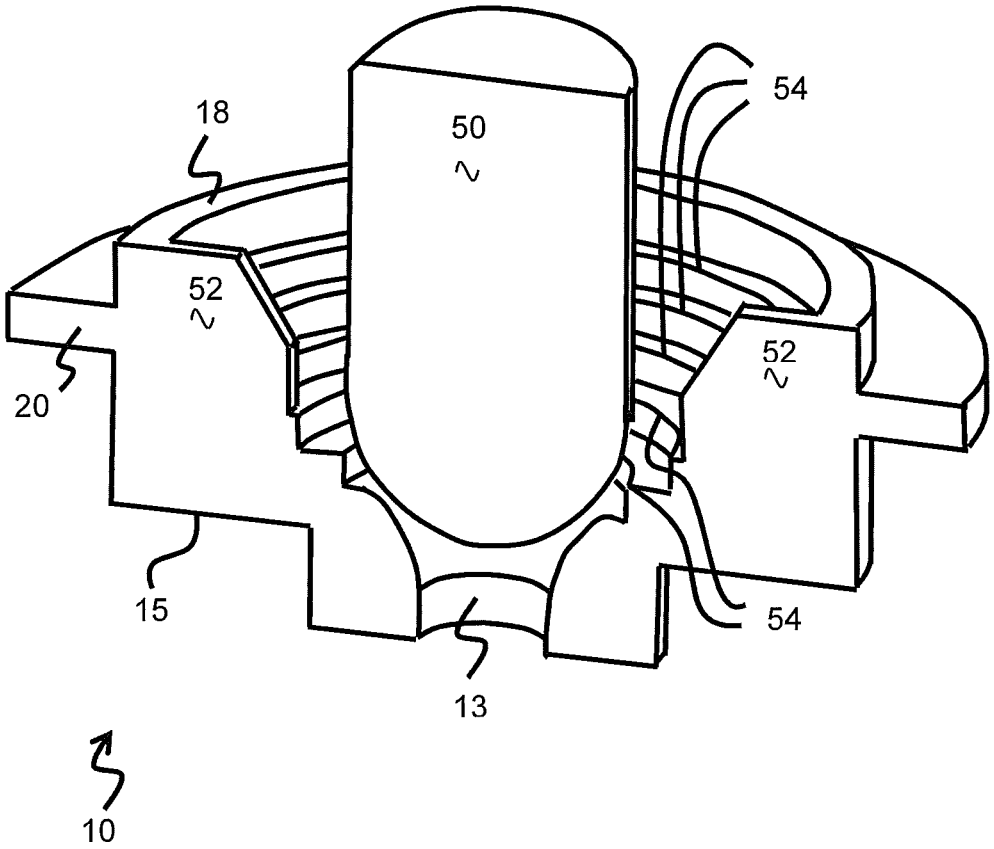
FIG. 11 is a perspective representation of a refractory element having an outward lip located between the top and bottom of a circumferential wall, and a circumferential wall stepped interior surface.

FIG. 11 depicts an embodiment of refractory element or block 10 containing a plurality of levels of internal steps 54 formed in the face of the wall interior surface. Fins 52 and steps 54 cooperate with a stopper occupying stopper volume 50 to minimize the formation of vortices and to produce turbulence in the flow through main orifice 13 to minimize deposition. Wall circumferential lip 20 is displaced below the plane of the wall upper surface 18, and is displaced from the plane of base lower surface 15.

Figure 12:
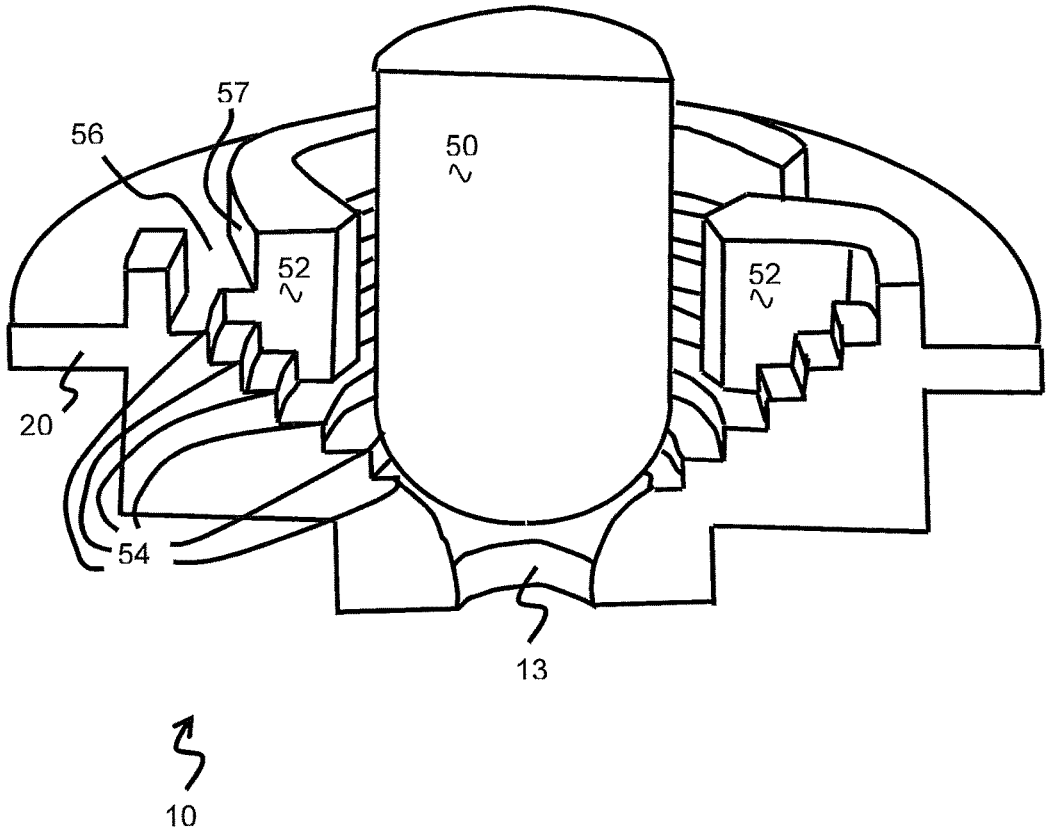
FIG. 12 is a cross-section of a perspective view of a refractory element having an outward lip located between the top and bottom of a circumferential wall, a circumferential wall stepped interior surface, and angled entrance flow openings.

FIG. 12 depicts an embodiment of refractory element or block 10 containing a plurality of levels of internal steps 54 formed in the face of the wall interior surface. Fins 52 and steps 54 cooperate with a stopper occupying stopper volume 50 to minimize the formation of vortices and to produce turbulence in the flow through main orifice 13 to minimize deposition. A wall circumferential lip 20 extends horizontally and outwardly from the exterior of the wall of block 10. Entrance flow openings 56 have, at their entrances, a lower surface equivalent to wall circumferential lip upper surface 22. Entrance flow openings 56 are defined, in the horizontal plane, by surfaces of adjacent internal fins 52. Entrance flow openings 56 are in fluid communication with the interior of the device or block, and direct flow onto internal steps 54. Entrance flow openings 56 are flared inwardly in the horizontal plane. In certain embodiments, entrance flow openings 56 have a wall having an initial vertical surface 57 contained in a plane that does not intersect stopper volume 50. This geometry maximizes flow rotation around the stopper.

Figure 13:
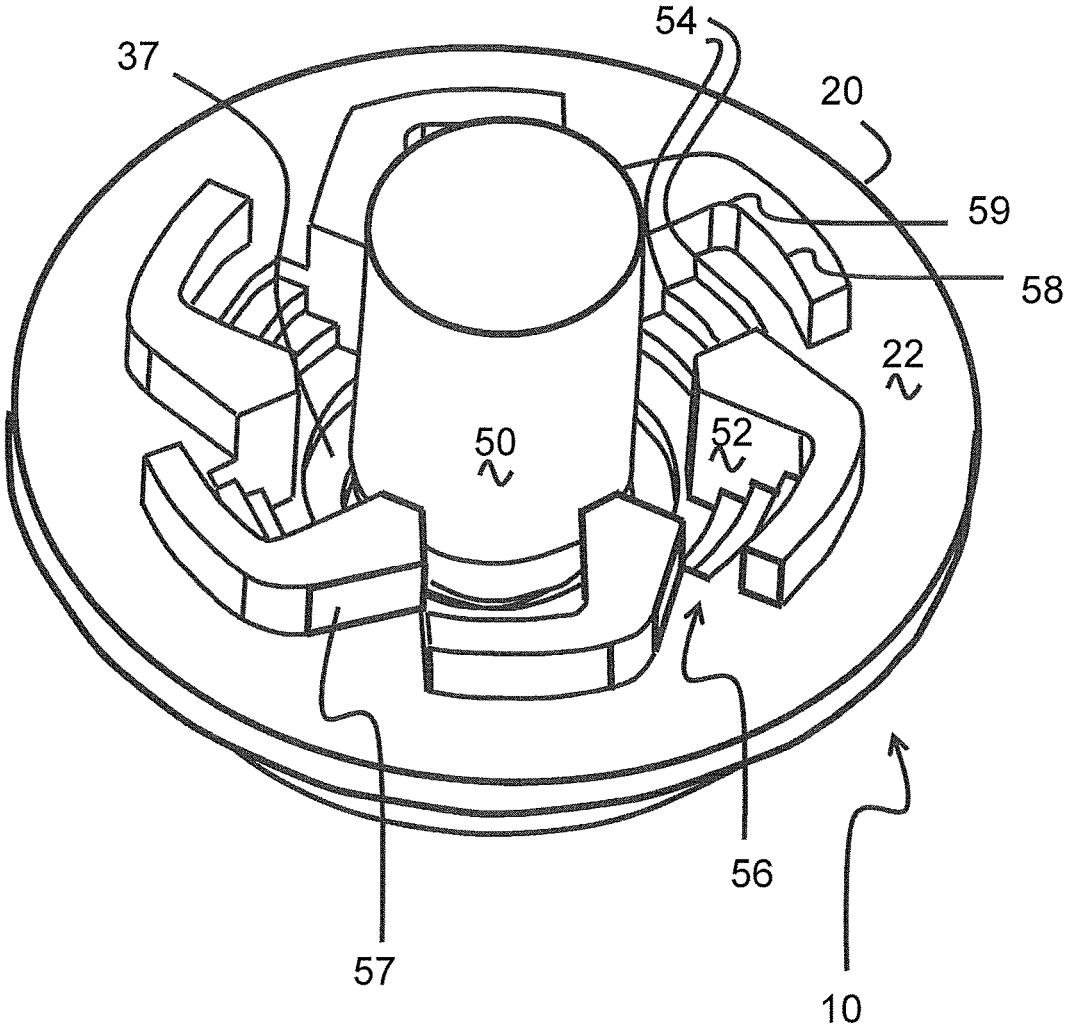
FIG. 13 is a perspective view of a refractory element having an outward lip located between the top and bottom of a circumferential wall, a circumferential wall stepped interior surface, and six angled entrance flow openings.

FIG. 13 depicts an embodiment of refractory element or block 10 containing a plurality of levels of internal steps 54 formed in the face of the wall interior surface. Fins 52 and steps 54 cooperate with a stopper occupying stopper volume 50 to minimize the formation of vortices and to produce turbulence in the flow through the main orifice to minimize deposition. A wall circumferential lip 20 extends horizontally and outwardly from the exterior of the wall of block 10. Entrance flow openings 56 have, at their entrances, a lower surface equivalent to wall circumferential lip upper surface 22. Entrance flow openings 56 are defined, in the horizontal plane, by surfaces of adjacent internal fins 52. Entrance flow openings 56 are in fluid communication with the interior volume 37 of the device or block, and direct flow onto internal steps 54. Entrance flow openings 56 are flared inwardly in the horizontal plane. In certain embodiments, entrance flow openings 56 have a wall having an initial vertical surface 57 contained in a plane that does not intersect stopper volume 50. This geometry maximizes flow rotation around the stopper. In this embodiment, entrance flow openings 56 have an outer wall 58 having an entrance flow opening outer wall concave section 59. In certain embodiments, the angle formed by the entrance flow opening outer wall concave section 59 is in the range from 90 degrees to 160 degrees, from 190 degrees to 150 degrees, from 90 degrees to 140 degrees, from 90 degrees to 130 degrees, from 90 degrees to 120 degrees, from 90 degrees to 110 degrees, from 100 degrees to 160 degrees, from 100 degrees to 150 degrees, from 100 degrees to 140 degrees, from 100 degrees to 130 degrees, from 100 degrees to 120 degrees, or from 100 degrees to 110 degrees.

Figure 14:
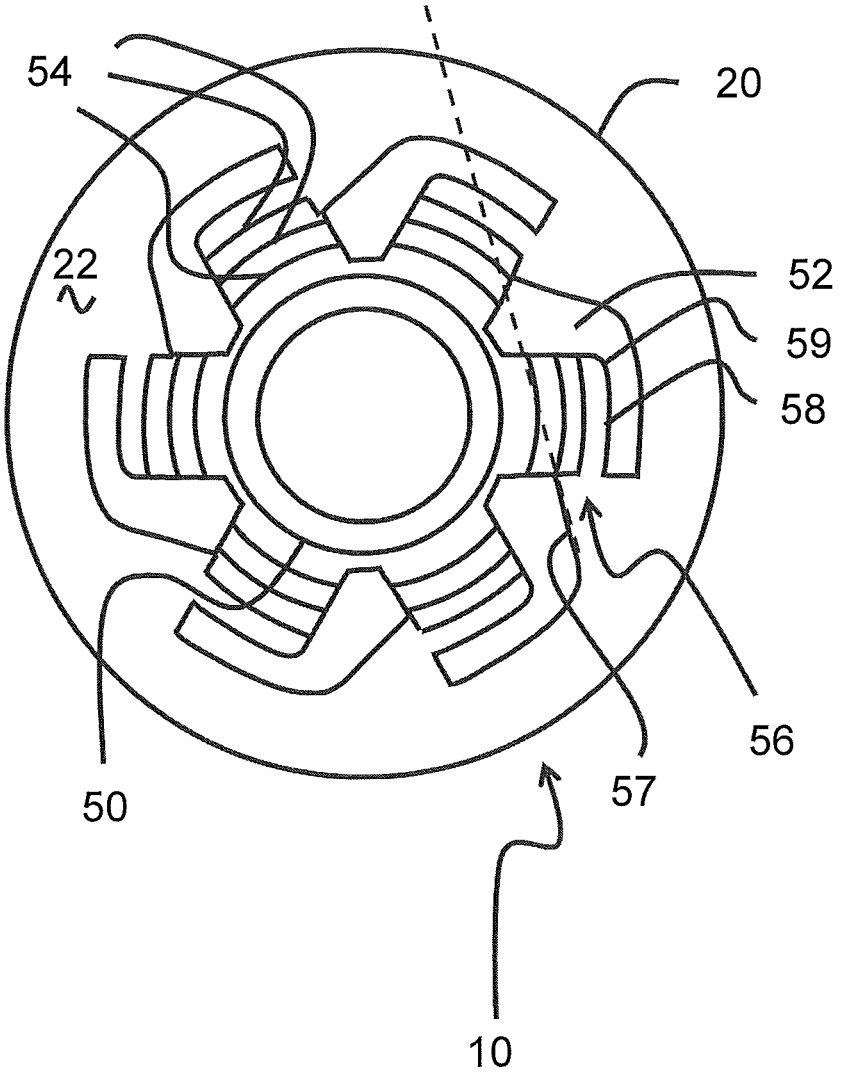
FIG. 14 is a top view of a refractory element having an outward lip located between the top and bottom of a circumferential wall, a circumferential wall stepped interior surface, and six angled entrance flow openings.

FIG. 14 is a top view of an embodiment of refractory element or block 10 containing a plurality of levels of internal steps 54 formed in the face of the wall interior surface. Fins 52 and steps 54 cooperate with a stopper occupying stopper volume 50 to minimize the formation of vortices and to produce turbulence in the flow through the main orifice to minimize deposition. A wall circumferential lip 20 extends horizontally and outwardly from the exterior of the wall of block 10. Entrance flow openings 56 have, at their entrances, a lower surface equivalent to wall circumferential lip upper surface 22. Entrance flow openings 56 are defined, in the horizontal plane, by surfaces of adjacent internal fins 52. Entrance flow openings 56 are in fluid communication with the interior volume of the device or block, and direct flow onto internal steps 54. Entrance flow openings 56 are flared inwardly in the horizontal plane. In certain embodiments, entrance flow openings 56 have a wall having an initial vertical surface 57 contained in a plane that does not intersect stopper volume 50. In FIG. 14, the plane containing wall initial vertical surface 57 is indicated by a dotted line that does not intersect stopper occupying volume 50. This geometry maximizes flow rotation around the stopper. In this embodiment, entrance flow openings 56 have an outer wall 58 having an entrance flow opening outer wall concave section 59. Entrance flow opening outer wall concave section 59 redirects inwardly the outer portion of flow through entrance flow opening 56. In this embodiment, the major axis, in the horizontal plane, of entrance flow openings 56 is not collinear with any horizontal radius of the stopper volume. This configuration induces flow rotation within the interior volume of block 10.

Figure 15:
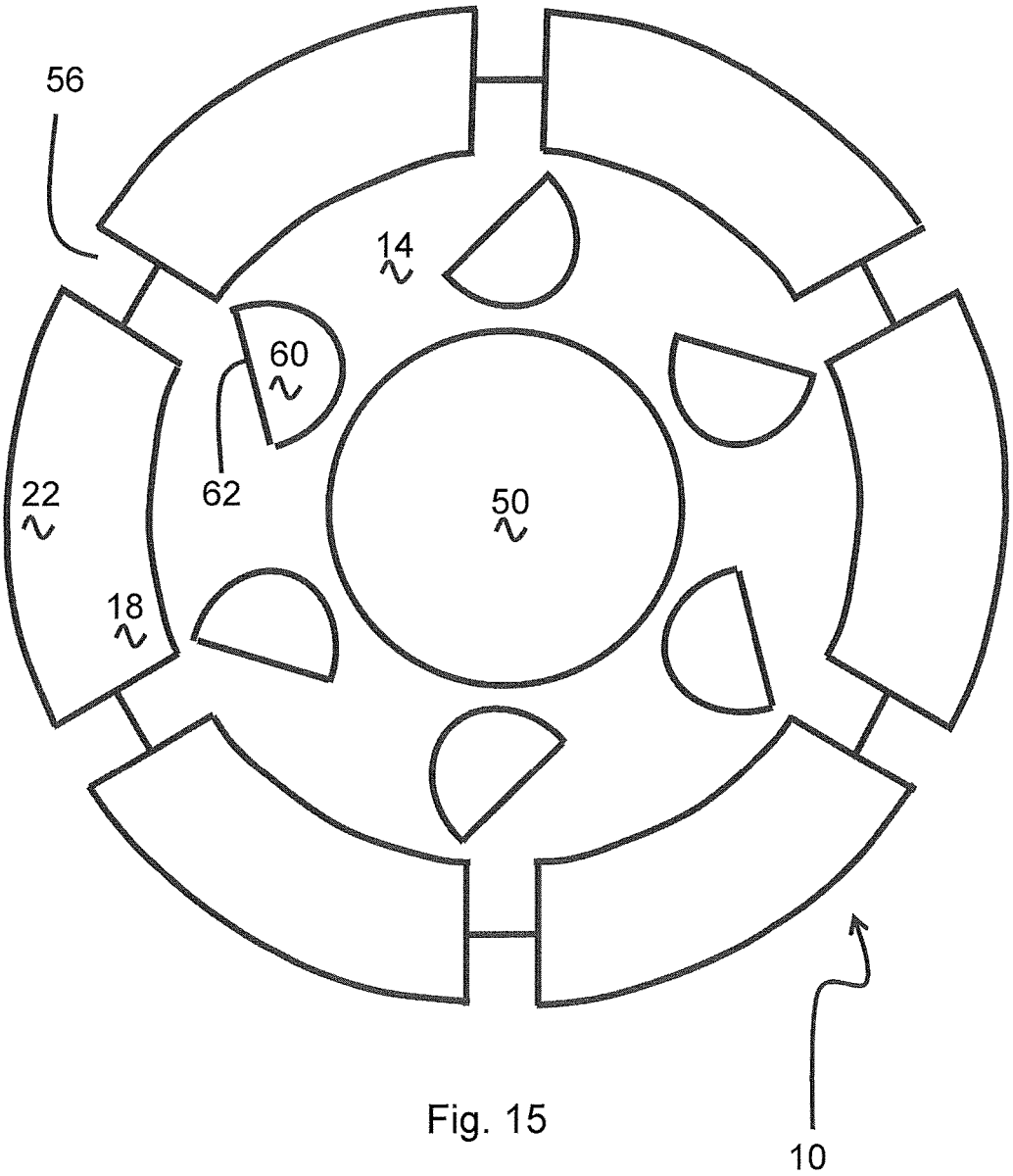
FIG. 15 is a top view of a refractory element having an outward lip extending outwardly from a circumferential wall, entrance flow openings, and flow directors between the entrance flow openings and the major vertical axis of the element.

FIG. 15 is a top view of an embodiment of block 10 of the invention. In this embodiment, walls extend upwardly from base upper surface 14, and wall upper surface 18 is visible in this view. A wall circumferential lip projects outwardly from the wall; wall circumferential lip upper surface 22 is visible in this view. The wall and the wall circumferential lip are interrupted circumferentially by entrance flow openings 56. In this embodiment, the major axis, in the horizontal plane, of each entrance flow opening 56 is collinear with a horizontal radius of the stopper volume 50. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. The angle other than a right angle may be in the range from 91° to 179°, 95° to 175°, 100° to 170°, 100° to 160°, 100° to 150°, 100° to 140°, 115° to 155°, or 120° to 150°. The deflector may also have any other geometry that redirects a flow through an entrance flow opening in a direction circumferential to the horizontal radius of stopper volume 50.

Figure 16:
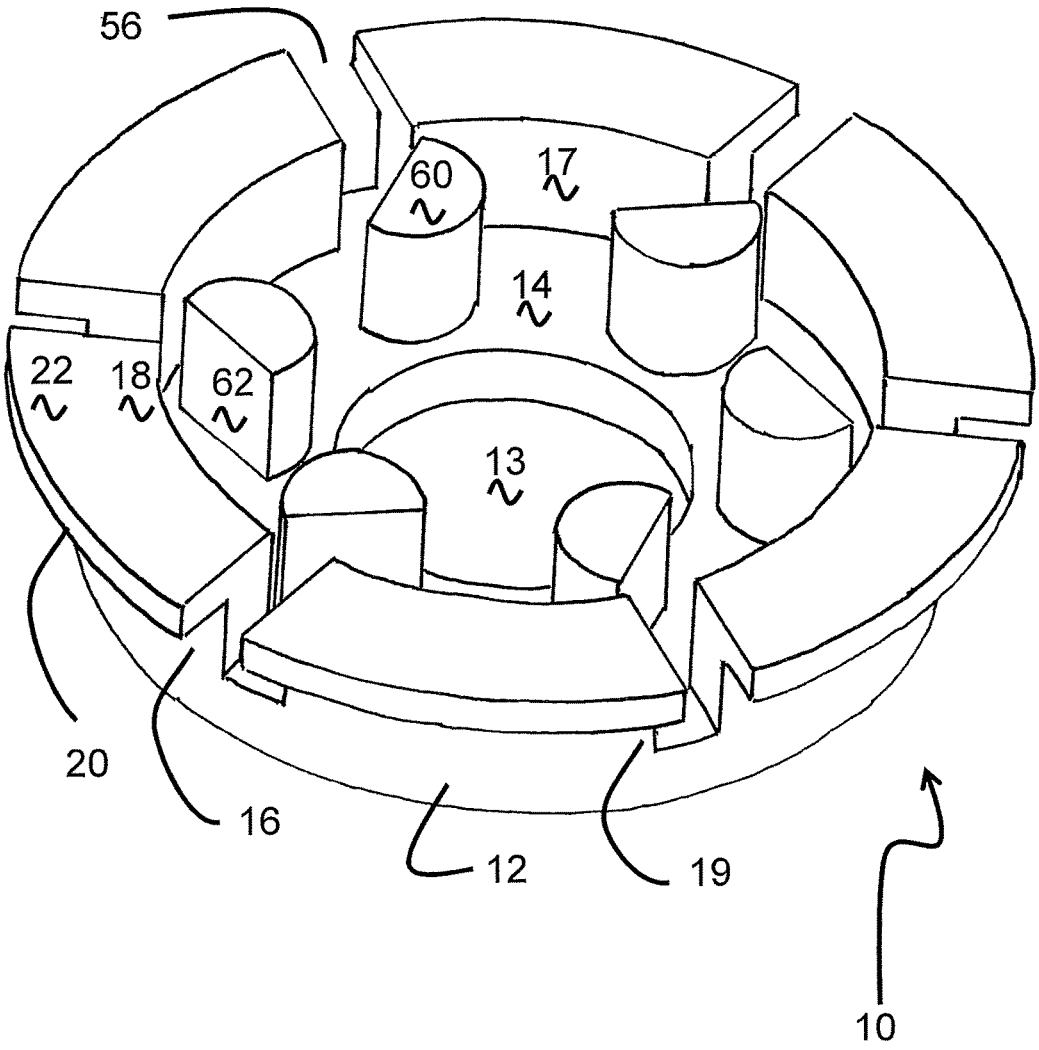
FIG. 16 is a perspective view of a refractory element having an outward lip extending outwardly from a circumferential wall, entrance flow openings, and flow directors between the entrance flow openings and the major vertical axis of the element.

FIG. 16 is a perspective representation of the embodiment of block 10 illustrated in FIG. 15. In this embodiment, walls 16 extend upwardly from base upper surface 14 of base 12; wall inner surface 17, wall upper surface 18 and wall outer surface 19 are visible in this view. Main orifice 13 passes vertically through base 12 between base upper surface 14 and the base lower surface. A wall circumferential lip 20 projects outwardly from wall 16; wall circumferential lip upper surface 22 is visible in this view. The wall and the wall circumferential lip are interrupted circumferentially by entrance flow openings 56. In this embodiment, the major axis, in the horizontal plane, of each entrance flow opening 56 is collinear with a horizontal radius of the longitudinal axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening.

Figure 17:
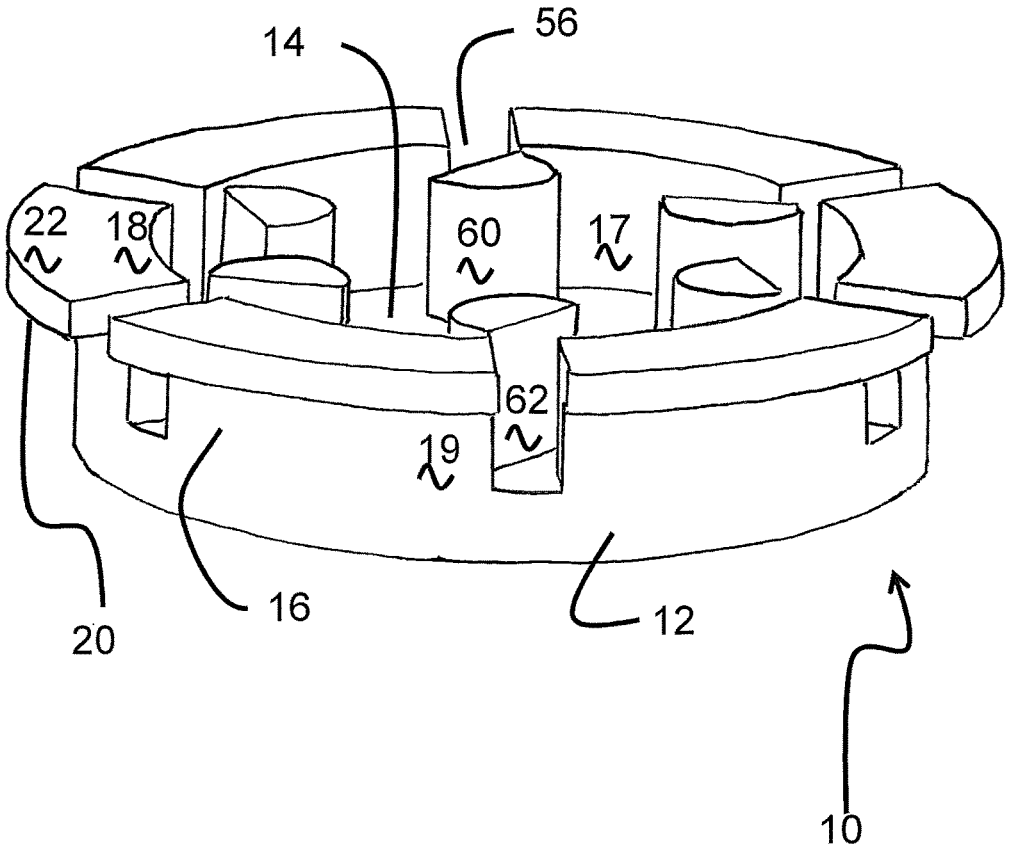
FIG. 17 is a perspective view of a refractory element having an outward lip extending outwardly from a circumferential wall, entrance flow openings, and flow directors between the entrance flow openings and the major vertical axis of the element.

FIG. 17 is an additional perspective representation of the embodiment of block 10 illustrated in FIG. 15. In this embodiment, walls 16 extend upwardly from base upper surface 14 of base 12; wall inner surface 17, wall upper surface 18 and wall outer surface 19 are visible in this view. A wall circumferential lip 20 projects outwardly from wall 16; wall circumferential lip upper surface 22 is visible in this view. Wall upper surface 18 and wall circumferential lip upper surface 22 are co-planar. The wall and the wall circumferential lip are interrupted circumferentially by entrance flow openings 56. In this embodiment, the major axis, in the horizontal plane, of each entrance flow opening 56 is collinear with a horizontal radius of the vertical longitudinal axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. The floors of entrance flow openings 56 are flat, and form right angles with the walls of the respective entrance flow openings 56.

Figure 18:
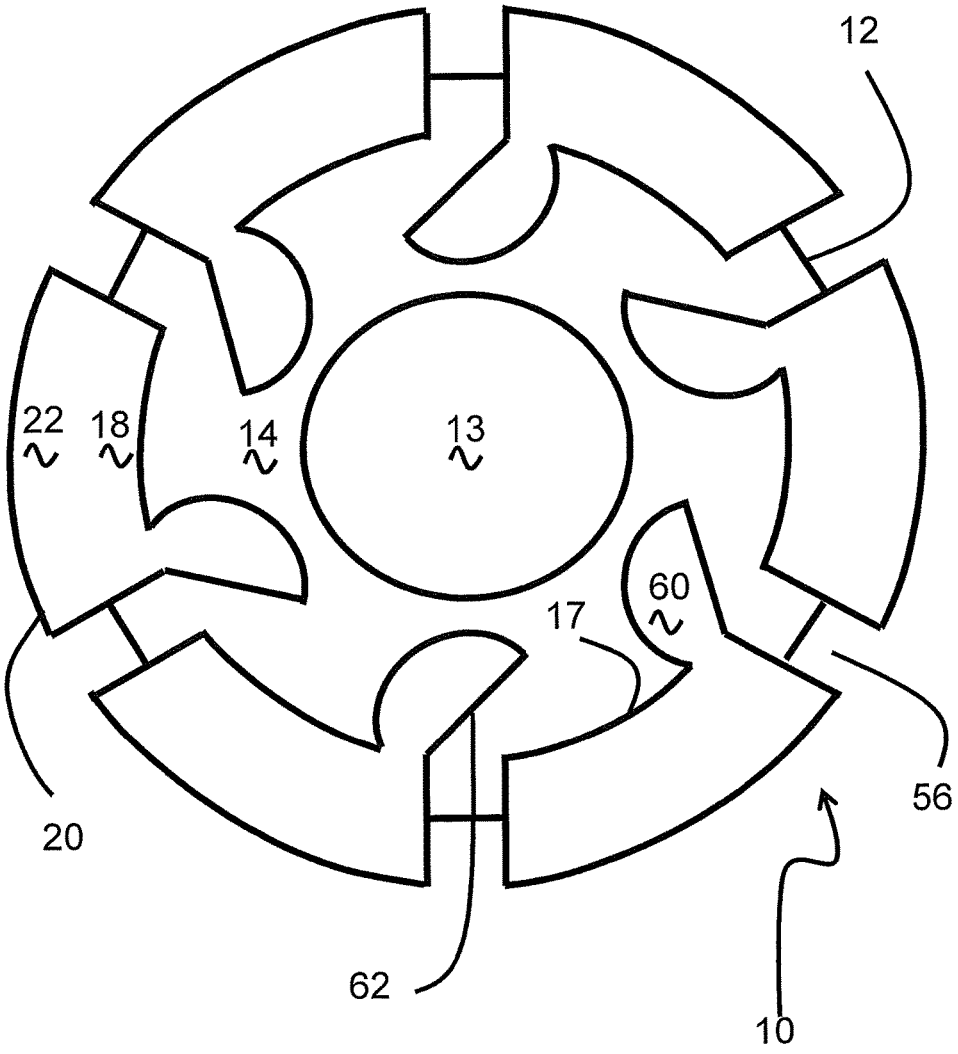
FIG. 18 is a top view of a refractory element having an outward lip extending outwardly from a circumferential wall, entrance flow openings, and flow directors between the entrance flow openings and the major vertical axis of the element, the flow directors being in direct communication with the interior of the circumferential wall.

FIG. 18 is a top view of an embodiment of block 10 of the invention. In this embodiment, walls extend upwardly from base upper surface 14, and wall upper surface 18 is visible in this view. Main orifice 13 passes vertically through base 12 between base upper surface 14 and the base lower surface. A wall circumferential lip 20 projects outwardly from the wall; wall circumferential lip upper surface 22 is visible in this view. The wall and the wall circumferential lip are interrupted circumferentially by entrance flow openings 56. In this embodiment, the major axis, in the horizontal plane, of each entrance flow opening 56 is collinear with a horizontal radius of extending from the central vertical axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, each deflector 60 is in direct communication with a portion of wall interior surface 17. In the embodiment shown each deflector 60 intersects a portion of wall interior surface along one line segment that is the vertex of an angle that is acute in the horizontal plane and at along another line segment that is the vertex of an angle that is obtuse in the horizontal plane. The obtuse angle is formed by the intersection of a wall of entrance flow opening 56 with angled facet 62.

Figure 19:
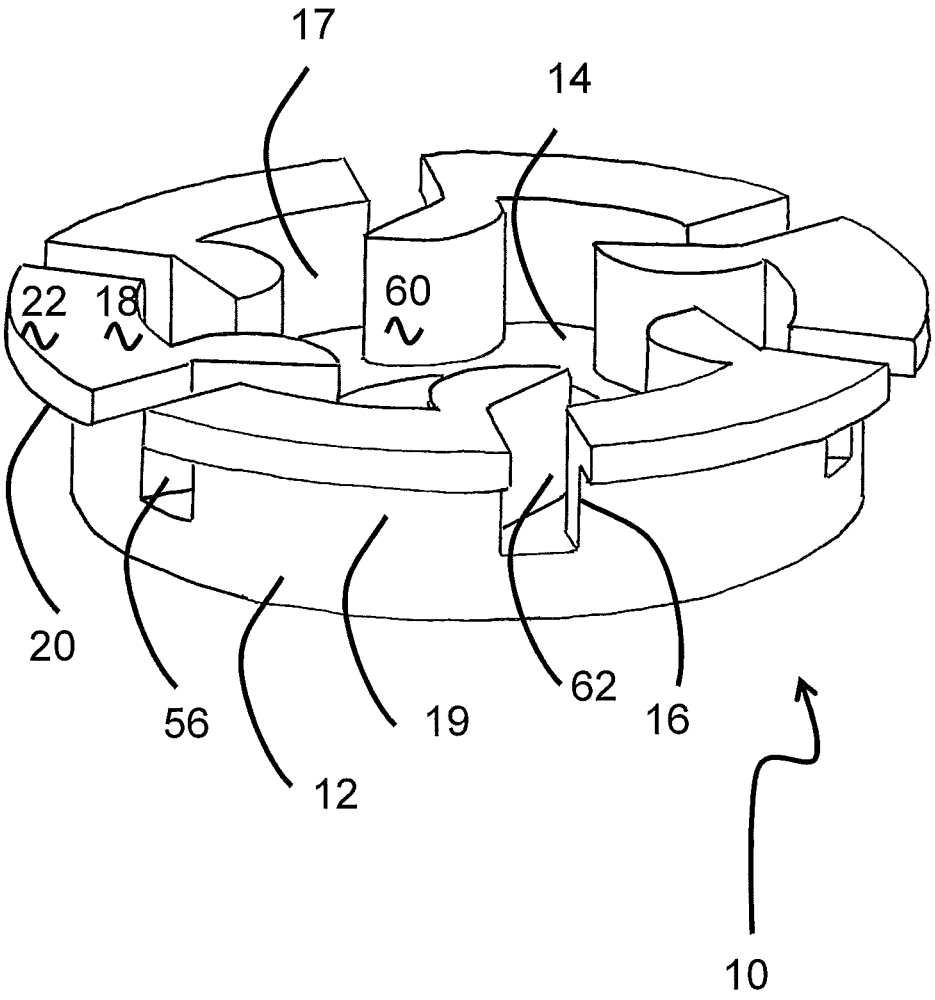
FIG. 19 is a perspective view of a refractory element having an outward lip extending outwardly from a circumferential wall, entrance flow openings, and flow directors between the entrance flow openings and the major vertical axis of the element, the flow directors being in direct communication with the interior of the circumferential wall.

FIG. 19 is a perspective representation of the embodiment of block 10 of the invention shown in FIG. 18. In this embodiment, wall 16 extends upwardly from base upper surface 14, and wall interior surface 17, wall upper surface 18 and wall exterior surface 19 are visible in this view. A wall circumferential lip 20 projects outwardly from the wall; wall circumferential lip upper surface 22 is visible in this view. The wall and the wall circumferential lip are interrupted circumferentially by entrance flow openings 56. In this embodiment, the major axis, in the horizontal plane, of each entrance flow opening 56 is collinear with a horizontal radius of extending from the central vertical axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, each deflector 60 is in direct communication with a portion of wall interior surface 17. In the embodiment shown each deflector 60 intersects a portion of wall interior surface along one line segment that is the vertex of an angle that is acute in the horizontal plane and at along another line segment that is the vertex of an angle that is obtuse in the horizontal plane. The obtuse angle is formed by the intersection of a wall of entrance flow opening 56 with angled facet 62.

Figure 20:
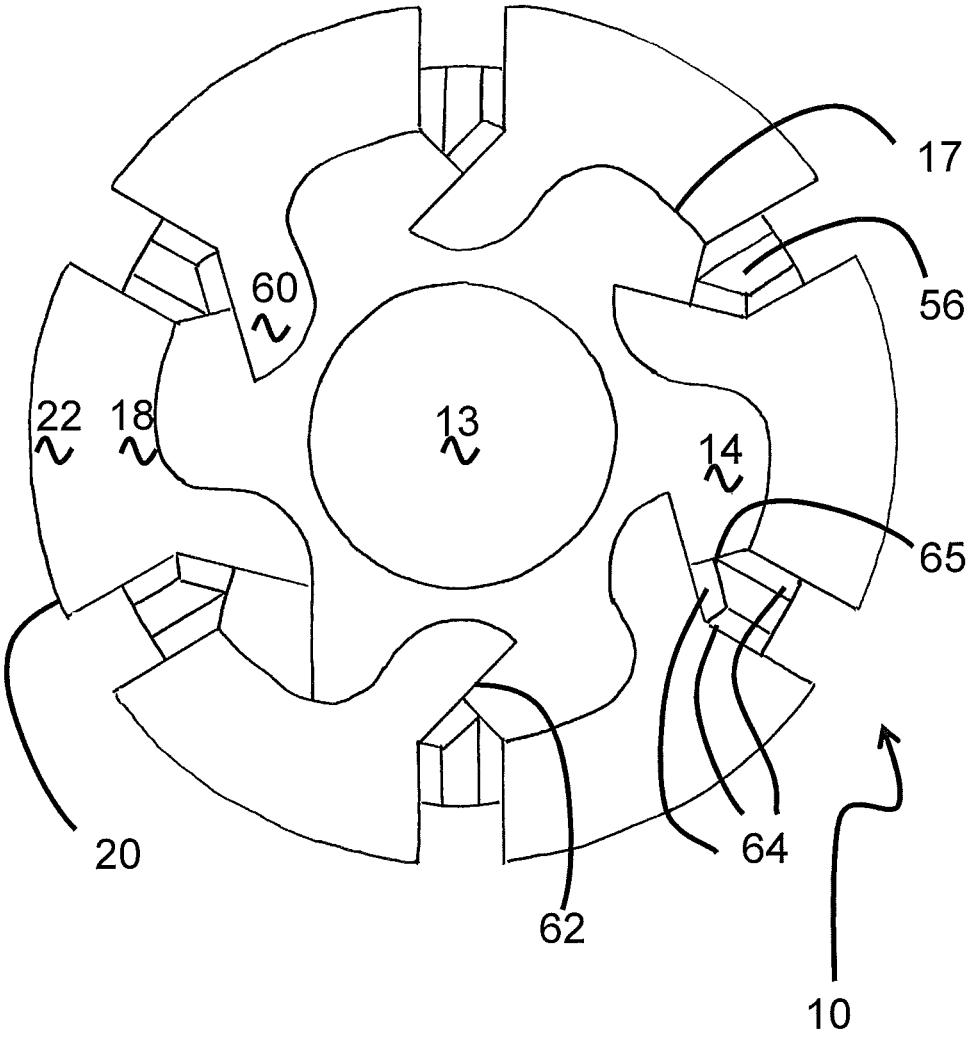
FIG. 20 is a top view of a refractory element having an outward lip extending outwardly from a circumferential wall, entrance flow openings in which the intersections of the opening bottom and the opening wall are beveled or rounded, and flow directors protruding inwardly from the circumferential wall between the entrance flow openings and the major vertical axis of the element.

FIG. 20 is a top view of an embodiment of block 10 of the invention. In this embodiment, walls extend upwardly from base upper surface 14, and wall upper surface 18 is visible in this view. Main orifice 13 passes vertically through the base between base upper surface 14 and the base lower surface. A wall circumferential lip 20 projects outwardly from the wall; wall circumferential lip upper surface 22 is visible in this view. The wall and the wall circumferential lip are interrupted circumferentially by entrance flow openings 56. In this embodiment, the major axis, in the horizontal plane, of each entrance flow opening 56 is collinear with a horizontal radius of extending from the central vertical axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, each deflector 60 is in direct communication with a portion of wall interior surface 17. In the embodiment shown each deflector 60 intersects a portion of wall interior surface along a vertical line segment that is the vertex of an angle that is obtuse in the horizontal plane. The obtuse angle is formed by the intersection of a wall of entrance flow opening 56 with angled facet 62. In the embodiment shown each deflector 60 also has an intersection with a portion of wall interior surface that is described by a concave curve in the horizontal plane. This curved surface redirects flow near wall interior surface 17 towards the interior volume of block 10. The floors of entrance flow openings 56 are horizontal and meet the walls of entrance flow openings 56 at rounded corners or radii 64. In other embodiments, the floors of entrance flow openings 56 are horizontal and meet the walls of entrance flow openings 56 through bevels. Entrance flow opening outlet 65 is the junction of the floor of the entrance flow opening with the base upper surface, and may take the form of a step.

Figure 21:
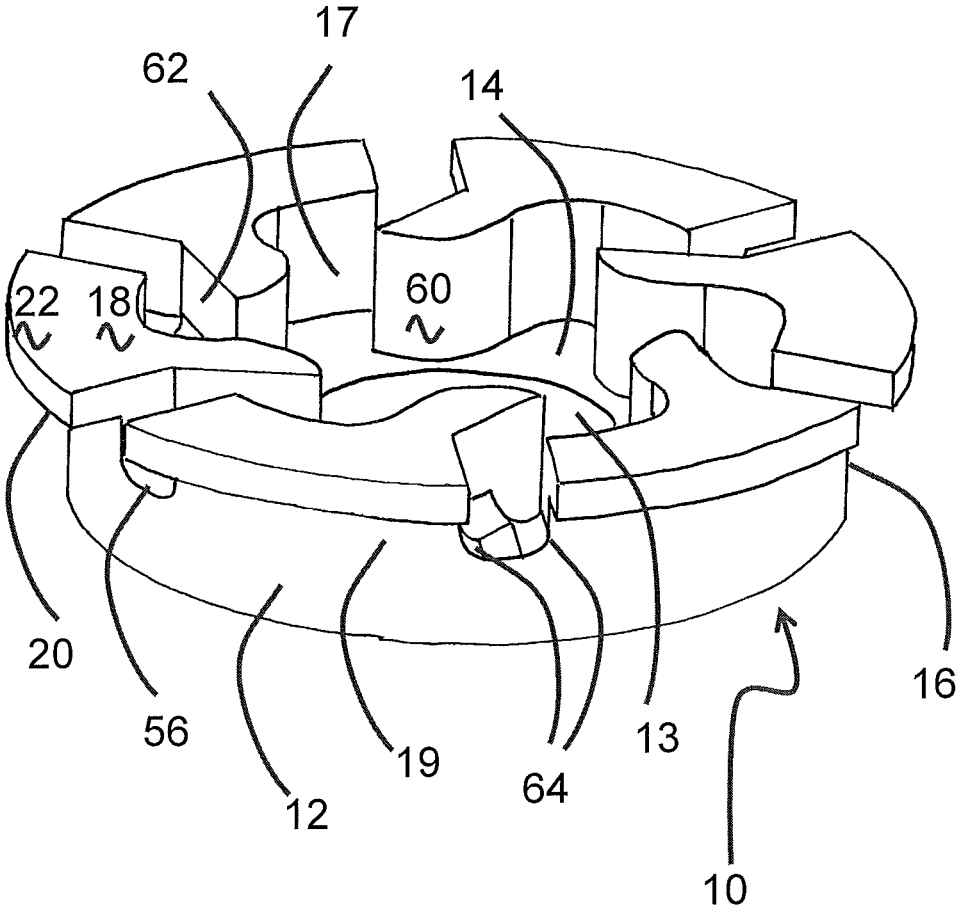
FIG. 21 is a top view of a refractory element having an outward lip extending outwardly from a circumferential wall, entrance flow openings in which the intersections of the opening bottom and the opening wall are beveled or rounded, and flow directors protruding inwardly from the circumferential wall between the entrance flow openings and the major vertical axis of the element.

FIG. 21 is a perspective view of the embodiment of block 10 of the invention shown in FIG. 20. In this embodiment, wall 16 extends upwardly from base upper surface 14 of base 12, and wall interior surface 17, wall upper surface 18 and wall exterior surface 19 are visible in this view. Main orifice 13 passes vertically through the base between base upper surface 14 and the base lower surface. A wall circumferential lip 20 projects outwardly from the wall; wall circumferential lip upper surface 22 is visible in this view. The wall and the wall circumferential lip are interrupted circumferentially by entrance flow openings 56. In this embodiment, the major axis, in the horizontal plane, of each entrance flow opening 56 is collinear with a horizontal radius of extending from the central vertical axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, each deflector 60 is in direct communication with a portion of wall interior surface 17. In the embodiment shown each deflector 60 intersects a portion of wall interior surface along a vertical line segment that is the vertex of an angle that is obtuse in the horizontal plane. The obtuse angle is formed by the intersection of a wall of entrance flow opening 56 with angled facet 62. In the embodiment shown each deflector 60 also has an intersection with a portion of wall interior surface that is described by a concave curve in the horizontal plane. This curved surface redirects flow near wall interior surface 17 towards the interior volume of block 10. The floors of entrance flow openings 56 are horizontal and meet the walls of entrance flow openings 56 at rounded corners or radii 64. In other embodiments, the floors of entrance flow openings 56 are horizontal and meet the walls of entrance flow openings 56 through bevels.

Figure 22:
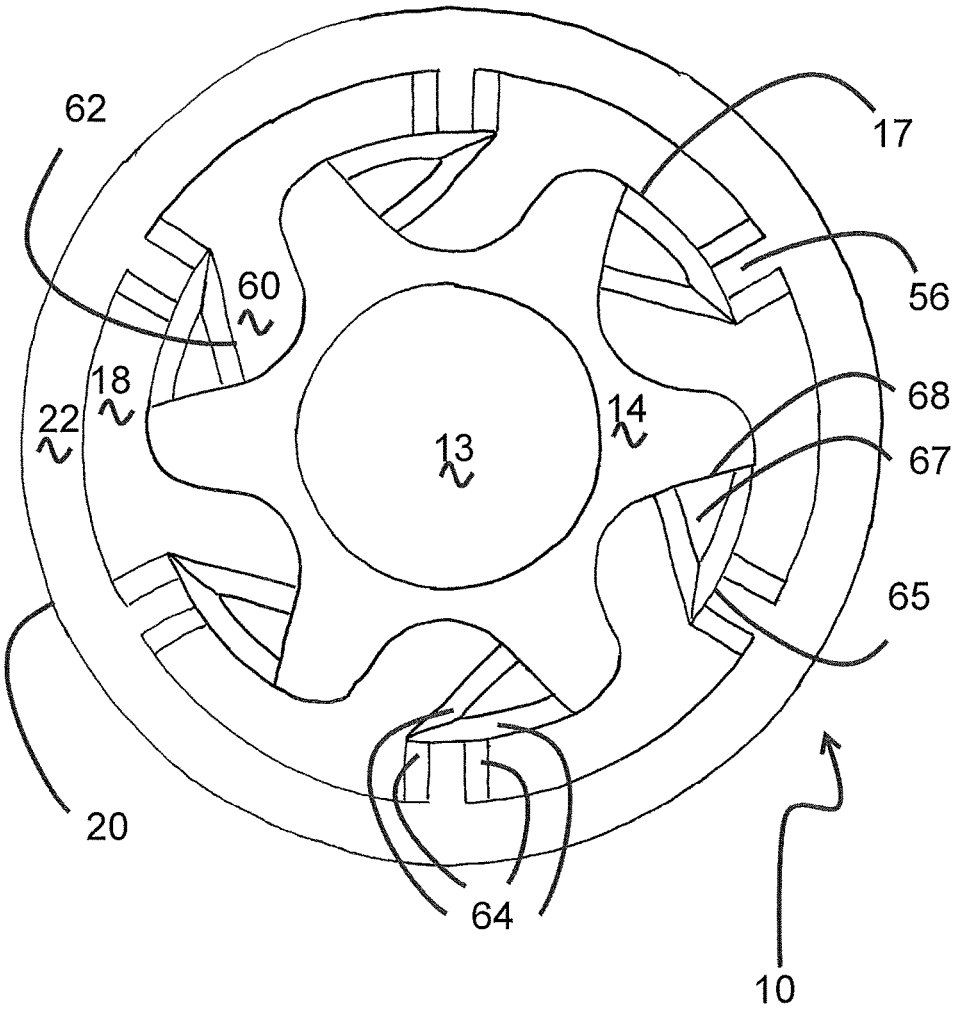
FIG. 22 is a perspective view of a refractory element having an outward lip extending outwardly from a circumferential wall, entrance flow openings in which the intersections of the opening bottom and the opening wall are beveled or rounded, and flow directors protruding inwardly from the circumferential wall between the entrance flow openings and the major vertical axis of the element.

FIG. 22 is a top view of an embodiment of block 10 of the invention. In this embodiment, walls extend upwardly from base upper surface 14, and wall upper surface 18 is visible in this view. Main orifice 13 passes vertically through the base between base upper surface 14 and the base lower surface. A wall circumferential lip 20 projects outwardly from the wall; wall circumferential lip upper surface 22 is visible in this view. In this embodiment wall upper surface 18 and wall circumferential lip upper surface 22 are not co-planar; wall circumferential lip upper surface 22 is below the level of wall upper surface 18. A top portion of the wall above wall circumferential lip upper surface 22 is interrupted circumferentially by entrance flow openings 56. In this embodiment, the major axis, in the horizontal plane, of each entrance flow opening 56 is collinear with a horizontal radius of extending from the central vertical axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, each deflector 60 is in direct communication with a portion of wall interior surface 17. In the embodiment shown each deflector 60 intersects a portion of wall interior surface along a vertical line segment that is the vertex of an angle that is obtuse in the horizontal plane. The obtuse angle is formed by the intersection of a wall of entrance flow opening 56 with angled facet 62. In the embodiment shown each deflector 60 also has an intersection with a portion of wall interior surface that is described by a concave curve in the horizontal plane. This curved surface redirects flow near wall interior surface 17 towards the interior volume of block 10. The floors of entrance flow openings 56 are horizontal and meet the walls of entrance flow openings 56 at rounded corners or radii 64. In other embodiments, the floors of entrance flow openings 56 are horizontal and meet the walls of entrance flow openings 56 through bevels. Entrance flow opening outlet 65 is located at the junction of the floor of the entrance flow opening with an intermediate entrance flow opening floor level 67, and may take the form of a step. In the illustrated embodiment, the intersections of intermediate entrance opening floor level 67 with angled facet 62 and wall interior surface 17 are in the form of rounded corners or radii 64. Intermediate volume outlet 68 is located at the junction of the floor of intermediate entrance flow opening floor level 67 and base upper surface 14, may be in the form of a step.

Figure 23:
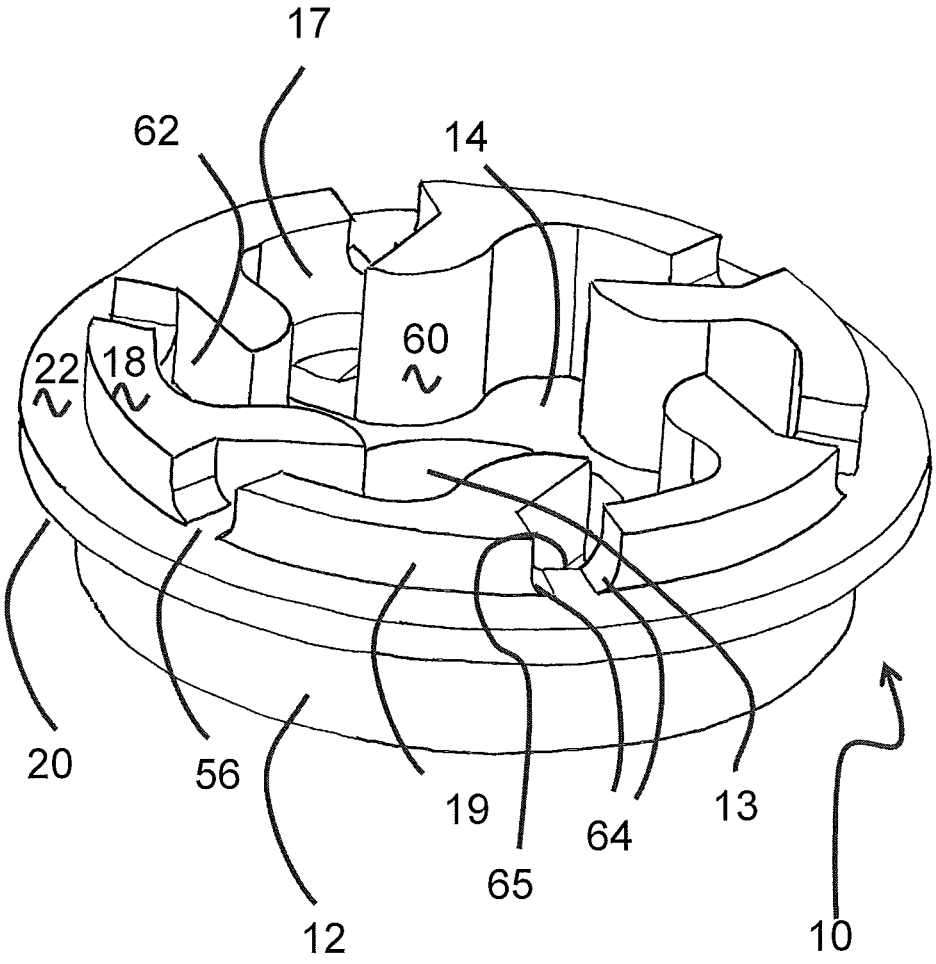
FIG. 23 is a perspective view of a refractory element having an outward lip extending outwardly from a circumferential wall between the top and bottom of the circumferential wall, entrance flow openings in which the intersections of the opening bottom and the opening wall are beveled or rounded, and flow directors protruding inwardly from the circumferential wall between the entrance flow openings and the major vertical axis of the element.

FIG. 23 is a perspective view of the embodiment of block 10 of the invention illustrated in FIG. 22. In this embodiment, walls extend upwardly from base upper surface 14, and wall interior surface 17, wall upper surface 18 and wall exterior surface 19 are visible in this view. Main orifice 13 passes vertically through the base between base upper surface 14 and the base lower surface. A wall circumferential lip 20 projects outwardly from the wall; wall circumferential lip upper surface 22 is visible in this view. In this embodiment wall upper surface 18 and wall circumferential lip upper surface 22 are not co-planar; wall circumferential lip upper surface 22 is below the level of wall upper surface 18. A top portion of wall above wall circumferential lip upper surface 22 is interrupted circumferentially by entrance flow openings 56. In this embodiment, the major axis, in the horizontal plane, of each entrance flow opening 56 is collinear with a horizontal radius of extending from the central vertical axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, each deflector 60 is in direct communication with a portion of wall interior surface 17. In the embodiment shown each deflector 60 intersects a portion of wall interior surface along a vertical line segment that is the vertex of an angle that is obtuse in the horizontal plane. The obtuse angle is formed by the intersection of a wall of entrance flow opening 56 with angled facet 62. In the embodiment shown each deflector 60 also has an intersection with a portion of wall interior surface that is described by a concave curve in the horizontal plane. This curved surface redirects flow near wall interior surface 17 towards the interior volume of block 10. The floors of entrance flow openings 56 are horizontal and meet the walls of entrance flow openings 56 at rounded corners or radii 64. In other embodiments, the floors of entrance flow openings 56 are horizontal and meet the walls of entrance flow openings 56 through bevels. Entrance flow opening outlet 65 is located at the junction of the floor of the entrance flow opening with an intermediate entrance flow opening floor level that may be depressed with respect to the floor of the entrance flow opening, and may take the form of a step.

Figure 24:
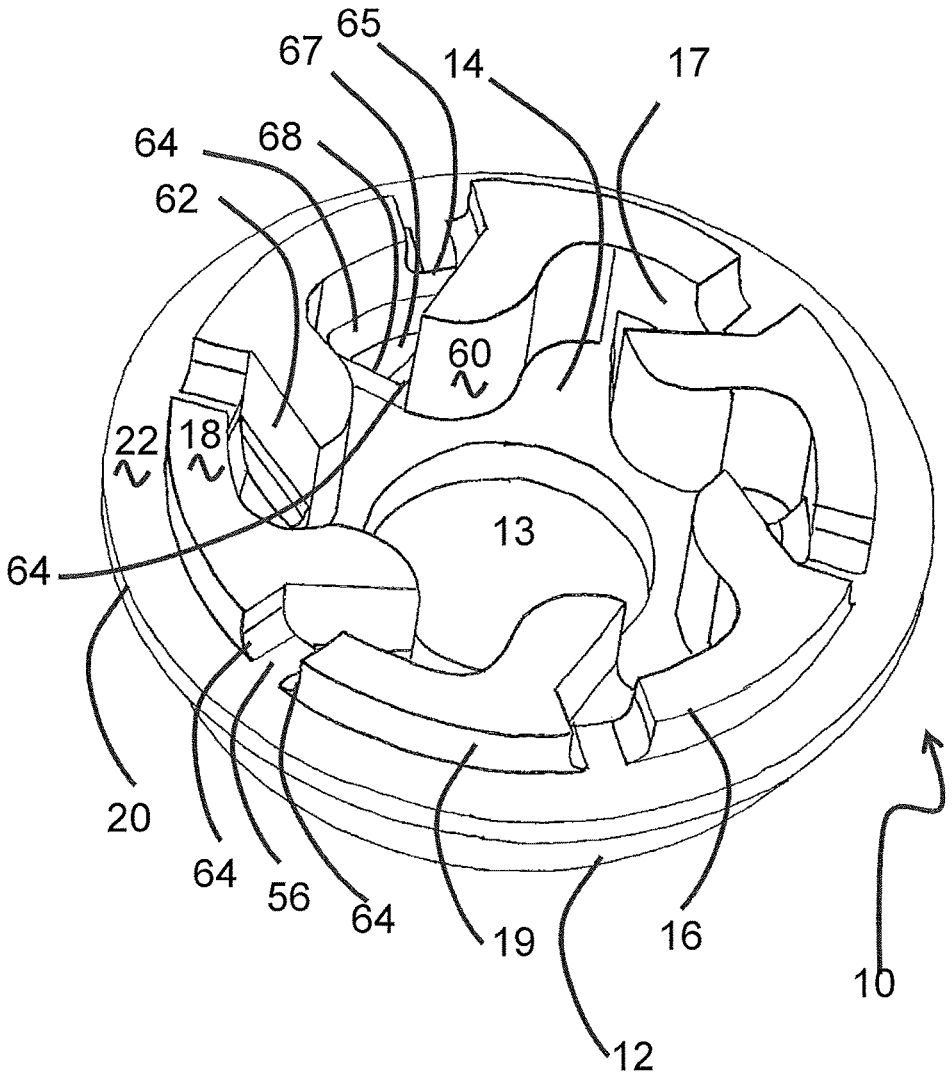
FIG. 24 is a perspective view of a refractory element having an outward lip extending outwardly from a circumferential wall between the top and bottom of the circumferential wall, entrance flow openings in which the intersections of the opening bottom and the opening wall are beveled or rounded, and flow directors protruding inwardly from the circumferential wall between the entrance flow openings and the major vertical axis of the element.

FIG. 24 is an additional perspective view of the embodiment of block 10 of the invention depicted in FIG. 22. In this embodiment, wall 16 extends upwardly from base upper surface 14, and wall interior surface 17, wall upper surface 18 and wall exterior surface 19 are visible in this view. Main orifice 13 passes vertically through the base between base upper surface 14 and the base lower surface. A wall circumferential lip 20 projects outwardly from wall 16; wall circumferential lip upper surface 22 is visible in this view. In this embodiment wall upper surface 18 and wall circumferential lip upper surface 22 are not co-planar; wall circumferential lip upper surface 22 is below the level of wall upper surface 18. A top portion of wall 16 above wall circumferential lip upper surface 22 is interrupted circumferentially by entrance flow openings 56. In this embodiment, the major axis, in the horizontal plane, of each entrance flow opening 56 is collinear with a horizontal radius of extending from the central vertical axis of block 10. The major axis in the horizontal plane of each entrance flow opening 56 intersects a deflector 60 extending upwardly from base upper surface 14. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, each deflector 60 is in direct communication with a portion of wall interior surface 17. In the embodiment shown each deflector 60 intersects a portion of wall interior surface along a vertical line segment that is the vertex of an angle that is obtuse in the horizontal plane. The obtuse angle is formed by the intersection of a wall of entrance flow opening 56 with angled facet 62. In the embodiment shown each deflector 60 also has an intersection with a portion of wall interior surface that is described by a concave curve in the horizontal plane. This curved surface redirects flow near wall interior surface 17 towards the interior volume of block 10. The floors of entrance flow openings 56 are horizontal, are co-planar with wall circumferential lip upper surface 22, and meet the walls of entrance flow openings 56 at rounded corners or radii 64. In other embodiments, the floors of entrance flow openings 56 are horizontal and meet the walls of entrance flow openings 56 through bevels. Entrance flow opening outlet 65 is located at the junction of the floor of the entrance flow opening with an intermediate entrance flow opening floor level 67, and takes the form of a step. In the illustrated embodiment, the intersections of intermediate entrance opening floor level 67 with angled facet 62 and wall interior surface 17 are in the form of rounded corners or radii 64. Intermediate volume outlet 68 is located at the junction of the floor of intermediate entrance flow opening floor level 67 and base upper surface 14, and takes the form of a step. Entrance flow opening 56 is in fluid communication with the volume above intermediate entrance floor level 67 by way of entrance flow opening outlet 65; the volume above intermediate entrance floor level 67 is fluid communication with the volume above base upper surface 14 by way of intermediate entrance flow opening outlet 68.

Figure 25:
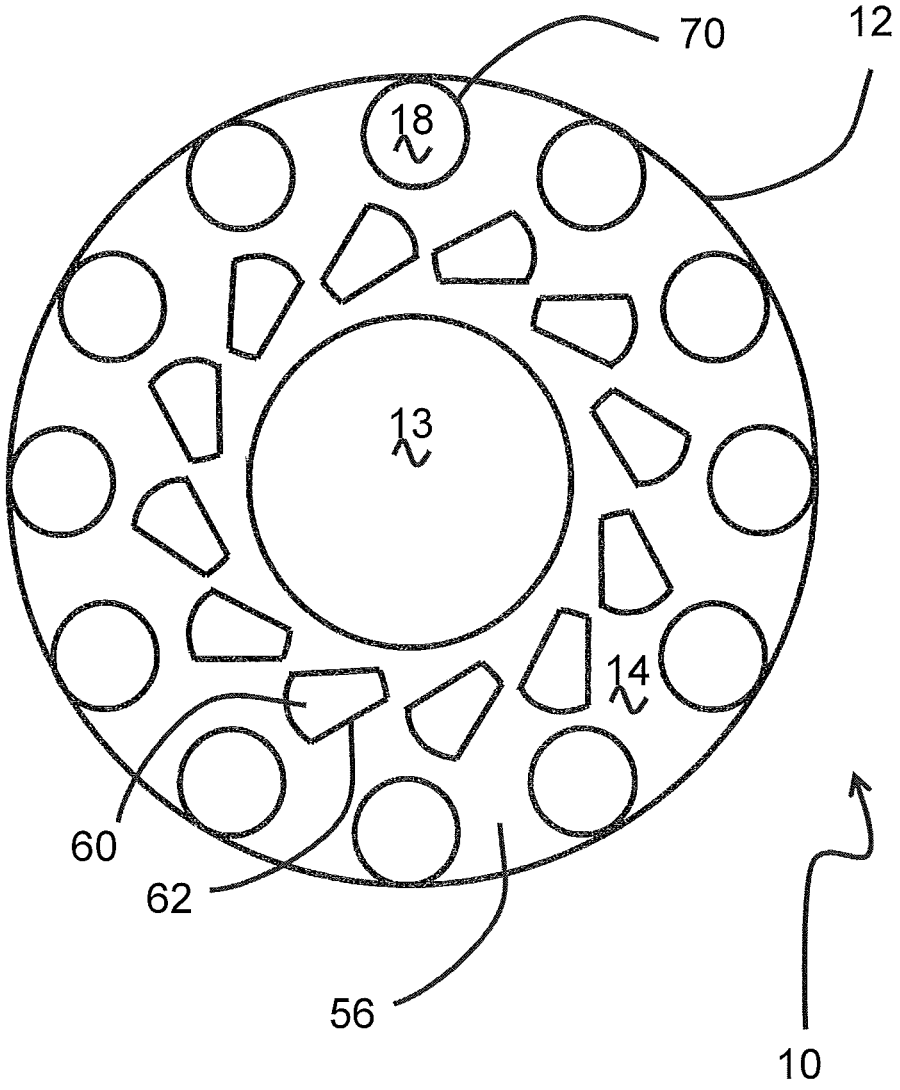
FIG. 25 is a top view of a refractory element in which the circumferential wall takes the form of a plurality of cylinders.

FIG. 25 is a top view of an embodiment of block 10 of the invention. In this embodiment, walls extending upwardly from base upper surface 14 take the form of a plurality of cylinders or columnar wall components 70 disposed around the circumference of base upper surface 14. The upper surfaces of columnar wall components 70 represent wall upper surface 18. Main orifice 13 passes vertically through the base between base upper surface 14 and the base lower surface. Entrance flow openings 56 are formed by the spaces between adjacent columnar wall components 70. This embodiment makes use of a plurality of columnar wall components 70. For example, 2, 3, 4, 5, 6, 7, 8, 9, 10, 11, 12, 13, 14, 15, 16, 17, 18, 19, 20, 21, 22, 23 or 24 columnar wall components may be used. Deflectors 60 extend upwardly from base upper surface 14 in the interior volume block 10 between the columnar wall components 70 and the central vertical axis of block 10. A line passing, in the horizontal plane, through the midpoint of an entrance flow opening 56 intersects a corresponding deflector 60. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, deflectors 60 take the form of cylinders or columns with a plurality of angled facets on the radial surfaces.

Figure 26:
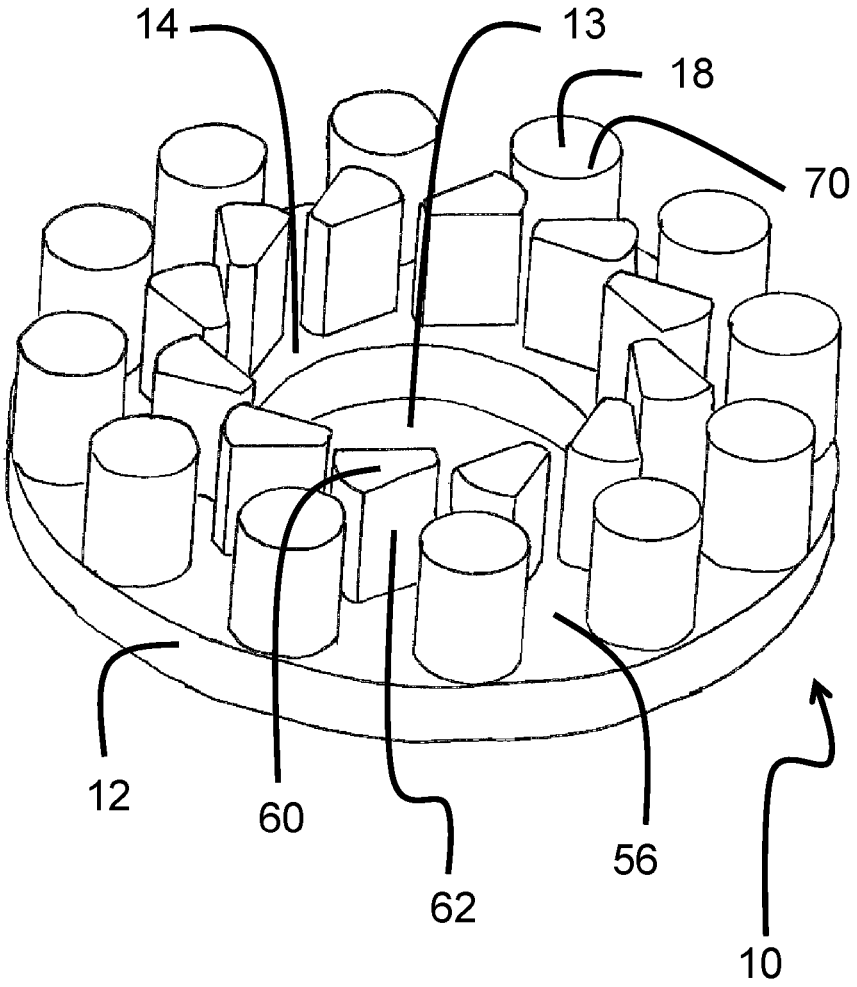
FIG. 26 is a perspective view of a refractory element in which the circumferential wall takes the form of a plurality of cylinders.

FIG. 26 is a perspective view of the embodiment of block 10 depicted in FIG. 25. In this embodiment, walls extending upwardly from base upper surface 14 take the form of a plurality of barriers or cylinders or columnar wall components 70 disposed around the circumference of base upper surface 14. The upper surfaces of barriers 70 represent wall upper surface 18. Main orifice 13 passes vertically through the base between base upper surface 14 and the base lower surface. Entrance flow openings 56 are formed by the spaces between adjacent barriers 70. This embodiment makes use of a plurality of barriers 70. Deflectors 60 extend upwardly from base upper surface 14 in the interior volume block 10 between the barriers 70 and the central vertical axis of block 10. A line passing, in the horizontal plane, through the midpoint of an entrance flow opening 56 intersects a corresponding deflector 60. Each deflector 60 comprises, in a direction facing a corresponding entrance flow opening 56, an angled facet 62 having an angle other than a right angle with the major axis, in the horizontal plane, of the corresponding entrance flow opening. In the embodiment depicted, deflectors 60 take the form of cylinders or columns with a plurality of angled facets on the radial surfaces.

Elements of the embodiments of the invention include:

10. Refractory element or block
12. Base
13. Main orifice or exit orifice
14. Base upper surface
15. Base lower surface
16. Wall
17. Wall interior surface
18. Wall upper surface
19. Wall exterior surface
20. Wall circumferential lip
22. Wall circumferential lip upper surface
24. Wall circumferential lip lower surface
25. Wall circumferential lip exterior surface
26. Lip shielded volume
28. Operating shielded height
30. Operating shielded volume
32. Internal height
34. Lip horizontal protrusion distance
36. Lip shielded volume height
37. Interior volume
38. Interior volume maximum horizontal dimension
40. Main orifice central axis
42. Wall upper surface elevation angle
44. WDD (wall elevation angle vertex displacement distance)
46. Lip lower surface elevation angle
48. LDD (lip lower surface elevation angle vertex displacement distance)
50. Stopper volume
52. Internal fin
54. Internal step
55. Tangent line to stopper nose / block seat contact
56. Entrance flow opening
57. Entrance flow opening initial vertical surface
58. Entrance flow opening outer wall
59. Entrance flow opening outer wall concave section
60. Deflector
62. Angled facet
64. Radius or rounded corner
65. Entrance flow opening outlet
67. Intermediate entrance flow opening floor level
68. Intermediate entrance flow opening outlet
70. Barrier Numerous modifications and variations of the present invention are possible. It is, therefore, to be understood that within the scope of the following claims, the invention may be practiced otherwise than as specifically described.

We claim:

1. A block for controlling flow from a refractory vessel, comprising:

a) a base disposed around a casting channel having a primary axis, the base having a base upper surface and a base lower surface, the base upper surface having a base upper surface circumference;

b) a wall extending from the circumference of the upper surface of the base, the wall having a wall upper surface;

wherein, from:

a) a first design feature, wherein the wall comprises a circumferential external surface having a top and a bottom, and wherein the block further comprises a wall circumferential lip extending radially outwardly from the circumferential external surface of the wall;

b) a second design feature, wherein the wall comprises a circumferential internal surface having a top and a bottom, and wherein the block further comprises an internal fin extending inwardly from the circumferential inner surface of the wall;

c) a third design feature, wherein the wall comprises a circumferential internal surface having a top and a bottom, wherein the wall circumferential internal surface comprises a plurality of steps, and wherein the wall circumferential internal surface has a radius with respect to the casting channel primary axis that decreases towards the bottom of the wall circumferential internal surface;

d) a fourth design feature, wherein the wall comprises a circumferential external surface having a top and a bottom, wherein the wall comprises a circumferential internal surface having a top and a bottom, wherein the wall comprises at least one entrance flow opening extending from the wall circumferential external surface to the wall circumferential internal surface;

e) a fifth design feature, wherein the wall comprises a plurality of barriers extending upwardly from the circumference of the base upper surface, and wherein each barrier is circumferentially adjacent on each side to another barrier to form a pair;

the block comprises a design feature selected from the group consisting of:

the third design feature, wherein the plurality of steps is located at a level above the level of the upper surface of the base;

the fourth design feature, wherein the at least one entrance flow opening extends upwardly to the wall upper surface, wherein the at least one entrance flow opening comprises a major axis in a horizontal plane, and wherein the block further comprises at least one deflector extending upwardly from the base upper surface and disposed between the at least one entrance flow opening and the primary axis of the casting channel; and the fifth design feature, wherein each pair of circumferentially adjacent barriers defines an entrance flow opening, and wherein each entrance flow opening comprises a central vertical plane, wherein the block comprises at least one deflector extending upwardly from the base upper surface and disposed between an entrance flow opening and the primary casting axis of the casting channel, and wherein the at least one deflector comprises an angled facet in a facet plane facing the central plane of the entrance flow opening, wherein the central vertical plane of the entrance flow opening intersects the facet plane of the deflector, and wherein the intersection of the central vertical plane of the entrance flow opening with the facet plane has an angle from and including 91 degrees to and including 179 degrees.

2. The block of claim 1, wherein the block comprises the fourth design feature.

3. The block of claim 2, wherein the at least one deflector comprises an angled facet facing the major axis of the at least one entrance flow opening in the horizontal plane, wherein a major axis of the at least one entrance flow opening intersects the angled facet of the deflector, and wherein an intersection of the major axis of the at least one entrance flow opening with the angled facet of the deflector has an angle, in the horizontal plane, from and including 91 degrees to and including 179 degrees.

4. The block of claim 2, wherein the major axis of the at least one entrance flow opening in the horizontal plane does not intersect the primary axis of the casting channel.

5. The block of claim 2, wherein the at least one deflector is in communication with the circumferential internal surface of the wall.

6. The block of claim 5, wherein the circumferential internal surface of the wall is concave with respect to the primary axis of the casting channel, wherein the at least one deflector comprises a surface that is in communication with the circumferential internal surface of the wall, and wherein the deflector surface that is in communication with the circumferential internal surface of the wall is convex with respect to the primary axis of the casting channel.

7. The block of claim 1, wherein the block comprises the fifth design feature.

8. The block of claim 6, wherein the at least one entrance flow opening is located above the wall circumferential lip.

9. The block of claim 1, wherein the block comprises the third design feature.

10. The block of claim 9, wherein the wall comprises a circumferential external surface having a top and a bottom, and wherein the block further comprises a wall circumferential lip extending radially outwardly from the circumferential external surface of the wall.

11. The block of claim 10, wherein the wall circumferential lip is displaced from the bottom of the circumferential external surface of the wall, and wherein a lip shielded volume is defined beneath the wall circumferential lip and exterior to the circumferential external surface of the wall.

12. The block of claim 10, wherein the wall circumferential lip is displaced from the top of the circumferential external surface of the wall.

13. The block of claim 9, wherein the block further comprises an internal fin extending inwardly from the circumferential inner surface of the wall.

14. The block of claim 10, wherein the block further comprises an internal fin extending inwardly from the circumferential inner surface of the wall.

* * * * *